US012532954B2

(12) United States Patent
Schwager

(10) Patent No.: US 12,532,954 B2
(45) **Date of Patent: *Jan. 27, 2026**

(54) CARRYING SYSTEM FOR A PIECE OF EQUIPMENT

(71) Applicant: Lindnerhof-Taktik GmbH, Lenggries (DE)

(72) Inventor: Martin Schwager, Penzberg (DE)

(73) Assignee: LINDNERHOF-TAKTIK GMBH, Lenggries (DE)

( * ) Notice: Subject to any disclaimer, the term of this patent is extended or adjusted under 35 U.S.C. 154(b) by 294 days.

This patent is subject to a terminal disclaimer.

(21) Appl. No.: 18/364,818

(22) Filed: Aug. 3, 2023

(65) Prior Publication Data

US 2024/0041190 A1 Feb. 8, 2024

(30) Foreign Application Priority Data

Aug. 5, 2022 (DE) ..... 10 2022 119 727.1

(51) Int. Cl.
*A45F 3/08* (2006.01)
*A45F 3/00* (2006.01)
*A45F 3/04* (2006.01)

(52) U.S. Cl.
CPC ..... *A45F 3/08* (2013.01); *A45F 3/047* (2013.01); *A45F 2003/003* (2013.01); *A45F 2003/045* (2013.01)

(58) Field of Classification Search
CPC ..... A45F 2003/045; A45F 3/08
(Continued)

(56) References Cited

U.S. PATENT DOCUMENTS 3,698,045 A * 10/1972 Redden ..... E04H 15/64 24/DIG. 37
5,361,955 A * 11/1994 Gregory ..... A45F 3/047 224/907

(Continued)

FOREIGN PATENT DOCUMENTS

DE 3232143 A1 3/1984
DE 10033738 A1 1/2002

(Continued)

OTHER PUBLICATIONS

Canadian Intellectual Property Office, Office Action Issued in Application No. 3,208,263, Dec. 13, 2024, 6 pages.

(Continued)

*Primary Examiner* — Justin M Larson
(74) *Attorney, Agent, or Firm* — McCoy Russell LLP

(57) ABSTRACT

The present disclosure provides a carrying system for an item of equipment, comprising a carrying rack on which shoulder straps and a waist strap are arranged, and a load carrier to which the item of equipment is releasably attachable, wherein the load carrier is formed by an inherently rigid carrying element which supports the weight of the item of equipment in the vertical direction. Provision is made for that the load carrier is releasably attachable to the carrying rack, wherein the load carrier preferably comprises connection elements for releasable connection to connection elements arranged at a lower end of the carrying rack, so that the introduction of force from the load carrier into the carrying rack takes place at the lower end thereof.

20 Claims, 15 Drawing Sheets

(58) Field of Classification Search
USPC ..... 224/628, 627, 642; 24/580.1
See application file for complete search history.

(56) References Cited

U.S. PATENT DOCUMENTS 5,540,364 A * 7/1996 Krieger ..... A63C 11/025 224/664
5,615,812 A * 4/1997 Martin ..... A45F 3/04 224/636
5,632,071 A * 5/1997 Maunder ..... A47H 13/00 24/DIG. 37
5,704,530 A * 1/1998 Scherer ..... A45F 3/08 224/634
5,725,139 A * 3/1998 Smith ..... A45F 3/02 224/637
6,857,820 B2 * 2/2005 Jacoway ..... B63C 11/02 405/187
7,644,847 B2 * 1/2010 Howell ..... A45F 3/08 224/628
8,066,164 B2 * 11/2011 Gregory ..... A45F 3/047 224/628
8,360,289 B2 * 1/2013 Thibadeau, Jr. ..... A45F 3/047 224/637
8,505,171 B2 * 8/2013 Colorado ..... A62B 9/04 224/675
8,584,917 B2 * 11/2013 Hexels ..... A45F 3/14 2/2.5
8,608,040 B2 * 12/2013 Cheesman ..... A62B 25/00 224/628
8,678,258 B1 * 3/2014 Knight ..... A45F 3/08 224/628
8,695,171 B2 4/2014 Colorado
8,814,020 B2 * 8/2014 Yaeger ..... A45F 3/06 224/665
8,919,628 B2 * 12/2014 Jamlang ..... A45F 3/10 224/583
8,950,644 B2 2/2015 Gleason, Jr.
8,997,262 B2 * 4/2015 Klein ..... A45F 3/08 2/2.5
9,027,813 B2 * 5/2015 Murdoch ..... A45F 3/04 224/637
9,232,848 B2 1/2016 Krikorian
9,462,875 B2 * 10/2016 Paduano ..... A45F 3/047
9,999,290 B2 6/2018 Klein
10,288,384 B2 * 5/2019 Kinnings ..... A45F 3/06
10,357,097 B1 7/2019 Goldberg
10,470,553 B1 11/2019 Gonzalez
10,893,708 B1 * 1/2021 Burnsed, Jr. ..... A41D 1/04
11,229,276 B2 1/2022 Simione
11,363,877 B2 * 6/2022 Wright ..... A45F 3/08
2005/0000993 A1 1/2005 Moskun
2005/0035170 A1 * 2/2005 Sears ..... A45F 3/12 224/628
2005/0092802 A1 * 5/2005 Maley ..... A45F 3/08 224/628
2006/0208024 A1 9/2006 Gleason, Jr.
2006/0289589 A1 12/2006 Gregory
2007/0158380 A1 7/2007 Calkin
2008/0257922 A1 10/2008 Cragg
2009/0282595 A1 * 11/2009 Branson ..... F41H 1/02 2/2.5
2010/0301085 A1 * 12/2010 Smith ..... A45F 3/14 224/645
2011/0278339 A1 * 11/2011 Hexels ..... A45F 3/08 224/676
2014/0151424 A1 * 6/2014 Hexels ..... A45F 3/06 224/637
2014/0263519 A1 * 9/2014 Saucedo ..... A45F 3/08 224/633
2014/0361058 A1 12/2014 Gill et al.
2015/0189974 A1 7/2015 Bercaw et al.
2015/0208791 A1 7/2015 Klein
2015/0313347 A1 * 11/2015 Murdoch ..... A45F 3/005 224/637
2016/0033235 A1 2/2016 Kinnings
2017/0311704 A1 11/2017 Geller
2020/0275763 A1 9/2020 Lennings et al.
2022/0007818 A1 1/2022 Rorich
2024/0041189 A1 * 2/2024 Schwager ..... A45F 3/047
2024/0041190 A1 * 2/2024 Schwager ..... A45F 3/10
2024/0349872 A1 * 10/2024 Reid ..... A45F 3/047

FOREIGN PATENT DOCUMENTS

DE 202008000644 U1 3/2008
KR 101837380 B1 3/2018
WO 8701017 A1 2/1987
WO 2006102091 A2 9/2006
WO 2006104368 A1 10/2006

OTHER PUBLICATIONS

Canadian Intellectual Property Office, Office Action Issued in Application No. 3,208,264, Dec. 13, 2024, 6 pages.
Canadian Intellectual Property Office, Office Action Issued in Application No. 3,208,263, Aug. 1, 2025, 3 pages.

* cited by examiner

CARRYING SYSTEM FOR A PIECE OF EQUIPMENT

CROSS REFERENCE TO RELATED APPLICATION

The present application claims priority to German Patent Application No. 10 2022 119 727.1 filed on Aug. 5, 2022. The entire contents of the above-listed application are hereby incorporated by reference for all purposes.

BACKGROUND

The present disclosure comprises a carrying system for an item of equipment, having a carrying rack to which shoulder straps and/or a waist strap are arranged, and having a load carrier to which the item of equipment can be releasably attached. The load carrier is also detachably attachable to the carrying rack. In a possible embodiment, the load carrier is formed by a rigid carrying element, in particular in the form of a carrying plate.

SUMMARY

A carrying system for an item of equipment is known from patent document US 2022/0007818 A1. The carrying system shown in this document is used for transporting chain saws, circular saws or hammers, such as those required by firefighters, and allows these items of equipment to be transported on the back in the manner of a backpack. The items of equipment are braced to the carrying plate by means of one or more tensioning straps, while positioning elements serve as stops which prevent the items of equipment from slipping out. In this document, however, no separate carrying rack is provided. Rather, the shoulder straps are attached to slots in the carrying plate. The carrying comfort is accordingly low.

A carrying rack to which various transport elements such as backpack bags can be attached in a modular fashion is known from WO 2006/102091 A2. Here, a frame is provided with a plurality of buckles to which items of equipment can be attached. The transport elements can also be attached to cross struts of the frame. However, this requires a relatively heavy structure, since the frame must absorb and distribute the forces exerted by the load. Furthermore, equipment is attached directly to the frame, which makes handling more difficult.

It is therefore an object of the present disclosure to provide an improved carrying system for transporting articles.

This object is achieved by the carrying systems as described herein.

In accordance with a first aspect, the present disclosure comprises a carrying system for an item of equipment, comprising a carrying rack to which shoulder straps and a waist strap are disposed, and a load carrier to which the item of equipment is releasably attachable, wherein the load carrier is releasably attachable to the carrying rack, wherein the carrying rack comprises a load node having a reinforcing plate to which both the waist strap and connection elements are sewn for connection to the load carrier.

In contrast to the prior art, therefore, a load node with a reinforcing plate is selected instead of a frame structure for connecting loads to the carrying rack. This increases the carrying comfort and reduces the weight.

According to an aspect of the present disclosure, the carrying rack further comprises, in addition to the load node, a back plate.

However, instead of the back plate, the load node provided in addition to the back plate is used as the primary connection for loads to the carrying rack. This also increases the carrying comfort and reduces the weight.

According to a possible configuration, the back plate and the load node overlap in the pelvic area, wherein preferably, the load node is arranged on the side of the back plate facing away from the carrier.

According to a possible configuration, the load node and the back plate are connected to each other at their lower sides.

According to a possible configuration, the shoulder straps engage with the load node. Preferably, the shoulder straps engage with the load node independently of the back plate.

According to a possible configuration, the shoulder straps are connected to the load node in a height-adjustable manner, wherein preferably, strap members of the shoulder straps are guided starting from the load node to an upper side and/or front side of the shoulder straps, where they are fastened in a length-adjustable manner, and/or wherein the strap members of the shoulder straps are deflected at the load node.

The connection elements according to the first aspect may be used to connect to an inherently rigid load carrier, for example an inherently rigid load carrier as described in the following, or to connect to a load carrier that is not inherently rigid.

The connection elements are preferably textile loops, in particular belt loops.

Preferred aspects with respect to the configuration and arrangement of the connection elements or the structure of the carrying rack or the load carrier, which will be described in the following with respect to the second and third aspects, can also be used in the first aspect.

Further, the first aspect may be combined with the second and/or third aspect.

In particular, the connection elements sewn to the reinforcing plate of the load node may be connection elements according to the second and/or third aspect.

In a second aspect, the present disclosure comprises a carrying system for an item of equipment, comprising a carrying rack to which shoulder straps and a waist strap are arranged, and a load carrier to which the item of equipment is releasably attachable, wherein the load carrier is formed by an inherently rigid carrying element which supports the weight of the item of equipment in the vertical direction. In particular, the carrying element may be a carrying plate, in particular a carrying plate as described in the following.

The second aspect is characterized in that the carrying element can be detachably attached to the carrying rack. This significantly improves carrying comfort and ease of use.

According to a possible embodiment of the present disclosure, provision is made for that the load carrier comprises connection elements for releasable connection with connection elements arranged at a lower end of the carrying rack, so that the force transmission from the load carrier into the carrying rack takes place at the lower end thereof.

Due to the force application at the lower end of the carrying rack, the carrying rack, unlike known carrying racks, does not require a solid frame construction that would transmit forces from an upper side to the waist strap. Instead, the force is introduced in the area of the lower end of the carrying rack and in particular in the area of the waist strap.

In contrast, the stability in the vertical direction provided by the frame construction in the prior art is provided by the load carrier.

A lower end in the sense of the present disclosure is understood to be an area in the carrying rack which is not higher than 10 cm above the upper edge of the waist strap, preferably not higher than 5 cm above the upper edge of the waist strap. In a possible embodiment, a lower end in the sense of the present disclosure can be understood as an area in the carrying rack which is not higher than the upper edge of the waist strap and is preferably arranged below the waist strap.

According to a possible embodiment of the present disclosure, provision is made for that the connection elements are arranged on the load carrier in the region of its lower end.

For the purposes of the present disclosure, the lower end of the load carrier is preferably understood to be an area which extends below the vertical center of the load carrier, more preferably within the lowest 20% of the vertical extent, more preferably within the lowest 10%.

According to a possible embodiment of the present disclosure, provision is made for that a plurality of connection means arranged side by side in the horizontal direction are provided.

According to a possible embodiment of the present disclosure, provision is made for that the load carrier additionally comprises connection elements in the region of its upper end and/or its sides, by means of which it can be releasably connected to connection elements of the carrying rack. These upper and/or lateral connection elements preferably serve to stabilize the load carrier on the carrying rack.

According to a possible embodiment of the present disclosure, provision is made for that the connection between the connection elements on the carrying rack and the connection elements on the load carrier is made by a connecting means separate from the latter. In particular, the connecting means establishes a positive connection with the connection elements on the carrying rack and the connection elements on the load carrier.

According to a possible embodiment, the connection between the load carrier and the carrying rack is made via a rod extending through textile loops of the load carrier and/or the carrying rack, wherein preferably, a securing element is provided that secures the rod against sliding out of the loops.

According to a possible embodiment of the present disclosure, provision is made for that the connection between the load carrier and the carrying rack is made by means of textile loops, which are connected to each other by means of a connecting means.

According to a possible embodiment of the present disclosure, provision is made for that the connecting means is a rod which is pushed through the connection elements and in particular the loops.

According to a third aspect, the present disclosure comprises a carrying system for an item of equipment, comprising a carrying rack to which shoulder straps are arranged, and a load carrier to which the item of equipment is releasably attachable, wherein the load carrier is releasably attachable to the carrying rack. The third aspect is characterized in that the connection between the load carrier and the carrying rack is effected via at least one rod that extends through textile loops arranged on the load carrier and/or the carrying rack. This provides a connection option that is as easy to handle as it is stable and easy to manufacture.

According to a possible configuration, the rod is pushed through textile loops arranged on the load carrier and on the carrying rack for establishing the connection.

The embodiment according to the third aspect is initially independent of the embodiment according to the first aspect or the second aspect and can in particular also be used if the load carrier is not inherently rigid and/or cannot be detachably connected to the carrying rack, or if the load is applied from the load carrier to the carrying rack in a different manner. Preferably, however, both aspects are used in combination. In particular, in this case, the connection elements of the second aspect provided at the lower end can be formed by loops which are connected a rod in accordance with the third aspect. In this case, however, the connection elements according to the third aspect can also be used for connection to a load carrier which is not inherently rigid.

Further, the second and/or third aspect can also be combined with the first aspect.

Preferred embodiments, which may be used in both the first, second and/or aspects, are described below.

According to a possible embodiment of the present disclosure, provision is made for that the loops are arranged alternately on the load carrier and on the carrying rack. In particular, the loops are arranged so that they are aligned with each other in a connection position.

According to a possible embodiment of the present disclosure, provision is made for that the rod passes through the loops largely without play. This ensures a firm connection. In particular, the inner diameter of the loops corresponds to the diameter of the rod.

According to a possible embodiment of the present disclosure, a securing element is provided for securing the rod from slipping out of the loops.

According to a possible embodiment of the present disclosure, provision is made for that a flexible band is arranged at one end of the rod, which is pulled over the opposite end of the rod protruding from the loops to secure the connection. By this means, the connection can be secured very easily.

According to a possible embodiment of the present disclosure, provision is made for that the connection elements and, in particular, the loops for connection between the load carrier and the carrying rack are arranged in the region of the respective lower and/or upper end on a side of the load carrier or carrying rack facing the respective other element. In this way, they are protected from dirt and damage. In particular in the case of a connection according to the second aspect, the connection can nevertheless be easily made and released, since the rod only has to be pushed through the loops from the side.

According to a possible embodiment of the present disclosure, provision is made for that the connection elements and, in particular, the loops for connection between the load carrier and the carrying rack are arranged next to each other in the horizontal direction in the region of the respective lower and/or upper end. This allows a good load transmission in the vertical direction.

According to a possible embodiment of the present disclosure, provision is made for that the connection elements and in particular the loops for connection between the load carrier and the carrying rack are formed in the region of the respective lower and/or upper end by straps which are sewn to a flat material layer of the load carrier or carrying rack at two spaced-apart points. This allows suitably shaped and dimensionally stable loops to be formed which extend in an arcuate manner between the two seams.

According to a possible first embodiment of the present disclosure, provision is made for that the connection elements and in particular loops for connection are arranged in the region of the lower end at a distance from the lower edge of the load carrier.

According to a possible second embodiment of the present disclosure, provision is made for that the connection elements and, in particular, loops for connection in the region of the lower end are arranged immediately adjacent to the lower edge of the load carrier above the lower edge.

In both variants, the connection elements cannot be damaged when placed on the floor.

According to a possible embodiment of the present disclosure, provision is made for that the loops for connection are arranged in the region of the upper end in the region of the upper edge of the load carrier and, in particular, adjacent to the upper edge immediately below the upper edge.

According to a possible embodiment of the present disclosure, provision is made for that the load carrier can be detachably connected to the carrying rack via lateral connection elements. These serve in particular for lateral stabilization.

According to a possible embodiment of the present disclosure, provision is made for that the lateral connection elements are formed by strap members connecting the sides of the load carrier to the carrying rack.

According to a possible embodiment of the present disclosure, provision is made for that loops are arranged on the strap members, which can be releasably connected to loops on the respective other element via a connecting means. In particular, the connection is also made here in accordance with the second aspect.

According to a possible embodiment of the present disclosure, provision is made for that the strap members are arranged on the carrying rack and the loops for connection to the loops of the strap members are arranged directly on the load carrier, in particular in the region of its lateral edges. In this case, the strap members can be attached to the load carrier at a lateral back section and/or to waist strap padding elements of a waist strap.

According to a possible embodiment of the present disclosure, provision is made for that the load carrier comprises further connection elements and, in particular, loops in the region of the upper edge and/or lower edge and/or the side edges, which enable a further element, in particular a backpack element, to be connected.

According to a possible embodiment of the present disclosure, provision is made for that the loops for connection to the carrying rack and the further loops are arranged in pairs one above the other and/or side by side and/or are made in pairs by a webbing sewn several times to the load carrier.

According to a possible embodiment of the present disclosure, provision is made for that the carrying rack according to the second aspect further comprises a waist strap.

According to a possible embodiment of both the first aspect and the second aspect, provision is made for that the waist strap is attached and in particular sewn to a load node to which the connection elements and in particular the loops for connection to the load carrier are also attached and in particular sewn in the region of its lower end.

According to a possible embodiment of the present disclosure, provision is made for that the load node comprises a reinforcing plate. In particular, the connection elements and in particular the loops for connection to the load carrier are sewn to the reinforcement plate in the region of its lower end. In particular, both the waist strap and the connection elements are sewn to the reinforcing plate.

This aspect is as described above also an object of the present disclosure as part of the first aspect, but can also be provided independently therefrom or from the second and third aspects.

Preferred aspects which can be used in all three aspects are described in more detail below.

The reinforcing plate may be a plastic plate.

According to a possible embodiment of the present disclosure, provision is made for that the shoulder straps engage at the load node. The load node therefore preferably serves both to take up and distribute the loads in the horizontal direction and also in the vertical direction.

According to a possible embodiment of the present disclosure, provision is made for that the shoulder straps are connected to the load node in a height-adjustable manner. This allows the carrying rack to be adapted to carriers of different sizes.

In particular, provision is made for that straps for adjusting the height of the shoulder straps engage at the load node.

According to a possible embodiment of the present disclosure, provision is made for that strap members of the shoulder straps are guided starting from the load node to an upper side and/or front side of the shoulder straps, where they are fastened in a length-adjustable manner. This allows easy accessibility of the height adjustment.

According to a possible embodiment of the present disclosure, provision is made for that strap members of the shoulder straps are deflected at the load node. The deflection can in particular take place at buckles which are fastened, in particular sewn, to the load node via webbing. In particular, the strap members can extend from the shoulder straps in the direction of the load node, be deflected there and, starting from the deflection, be guided upwards again, where they are fastened in a length-adjustable manner According to a possible embodiment of the present disclosure, provision is made for that lateral wings, to which the lower front ends of the shoulder straps engage, and/or a back plate of the carrying rack is attached to the load node.

According to a possible embodiment of the present disclosure, provision is made for that lashing straps are arranged on the waist strap, for example on a waist strap padding of the waist strap or on a strap member of the waist strap, which can be connected to lateral connection elements of the load carrier.

According to a possible embodiment of the present disclosure, provision is made for that lashing straps are arranged on the shoulder straps, in particular on the shoulder strap padding. Preferably, the lashing straps are connectable to connection elements in the region of the upper end of the carrying rack and/or the load carrier, for example to connection elements arranged in the region of an upper edge of a back plate, a backpack element and/or load carrier. In particular, the lashing straps can be attached with a rod which is pushed through loops arranged at the upper ends of the carrying rack and the load carrier for connection.

According to a possible embodiment of the present disclosure, provision is made for that a waist strap padding is detachably arranged on the carrying rack.

According to a possible embodiment of the present disclosure, provision is made for that a stiffening member of the waist strap padding is slidable through a pocket of the carrying rack for connection to the carrying rack.

In particular, the waist strap pad stiffening member may be slidable through a pocket disposed between a back plate and the load node.

According to a possible embodiment of the present disclosure, provision is made for that slots are provided in the stiffening member on both sides, through which a loop can be pushed from behind, wherein the loop can be secured on the front side of the stiffening member by a rod which can be pushed through the loop.

According to a possible embodiment of the present disclosure, there is provided a flexible band at one end of the rod which is pulled over the opposite end of the rod to secure the connection.

According to a possible embodiment of the present disclosure, provision is made for that the loop is a loop of the waist strap which passes through a slot in or adjacent to the load node. In particular, it may be a slot provided between the load node and wings pivotally arranged on the load node.

According to a possible embodiment of the present disclosure, provision is made for that waist strap padding elements can be slid onto the free ends of the stiffening member.

According to a possible embodiment of the present disclosure, provision is made for that the waist strap padding elements each comprise at least one and preferably two loops arranged one above the other, through which the respective rod can be pushed in order to connect them to the loop passing through the stiffening member.

The waist strap padding elements can thus be connected to the carrying rack as easily as reliably.

According to a possible embodiment of the present disclosure, the waist strap padding elements comprise one or more loops on their rear side through which the waist strap can be pulled.

According to a possible embodiment of the present disclosure, the waist strap padding elements have buckles on their rear side, on which lashing straps are arranged in a length-adjustable manner.

According to a possible embodiment of the present disclosure, the load carrier can be detachably attached to the carrying rack in at least two vertical positions. This allows in particular an adjustment to the size of the carrier, especially in the case of height-adjustable shoulder straps.

In particular, fastening the load carrier in at least two vertical positions allows the load carrier to be arranged in the shoulder area sufficiently high with respect to the shoulder straps so that lashing straps between the shoulder straps and the load carrier become effective.

According to a possible embodiment of the present disclosure, the carrying rack has at its lower end at least two connection elements arranged vertically at different heights, to which connection elements of the load carrier can be selectively connected.

In particular, the carrying rack has at its lower end at least two rows of loops arranged at different heights, which can optionally be connected by a rod to loops of the load carrier, in particular as already described.

According to a possible embodiment of the present disclosure, the carrying rack has at its upper end at least two connection elements arranged vertically at different heights, in particular in the form of loops arranged vertically one above the other. Preferably, the loops arranged vertically one above the other are formed by a webbing sewn to itself and to the carrying rack, in particular to a back plate of the carrying rack.

According to a possible embodiment of the present disclosure, the carrying rack comprises at least two lateral connection elements arranged at different vertical heights, which can be optionally connected to connection elements of the load carrier.

According to a possible embodiment of the present disclosure, the load carrier comprises at least two positions offset in the vertical direction, in which stop elements for positioning the load carrier on a back plate of the carrying rack can be arranged as desired. In particular, these are vertically offset holes through a carrying plate serving as a load carrier.

According to a possible embodiment of the present disclosure, provision is made for that the carrying rack further comprises a back plate.

According to a possible embodiment, the back plate is adapted three-dimensionally to the shape of the back and, in particular, is formed by a shaped part adapted to the shape of the back in the horizontal and in the vertical direction.

According to a possible embodiment, the back plate extends from a pelvic region to a shoulder region. In particular, the shaped part extends from a pelvic region to a shoulder region.

The use of a shaped part enables a particularly high level of wearing comfort. At the same time, the stiffness of the back plate is increased by the horizontal and vertical shaping of the back plate, so that it can be used as a load-bearing element of the structure.

According to a possible embodiment of the present disclosure, the carrying rack further comprises a load node in the pelvic region to which the waist belt is attached. In particular, the waist belt may be sewn to the load node. In particular, the load node may be a load node according to the first aspect.

According to one possible embodiment of the present disclosure, the back plate is provided in addition to the load node and/or its reinforcing plate.

Preferably, the back plate and the load node, in particular the back plate and the reinforcement plate of the load node, overlap in the pelvic region. In particular, the load node can be provided on the side of the back plate facing away from the bearer.

The back plate is preferably connected at its lower edge to the lower edge of the load node, in particular sewn thereto. Preferably, the back plate and the load node run parallel to each other upwards from their connection point, preferably forming a laterally open pocket between them.

According to one possible embodiment of the present disclosure, it is provided that the shoulder straps are connected to the load node independently of the back plate. In particular, the shoulder straps are connected to the load node in such a way that the load is applied directly to the shoulder straps from the load node.

Preferably, the shoulder straps run along the back plate and/or on its rear side to the load node. The shoulder straps are preferably not directly connected to the back plate in the vertical direction. However, they may be guided laterally on the back plate. Preferably, a load is applied from the back plate to the shoulder straps in the vertical direction only via the load node.

According to one possible embodiment, the load node has a reinforcement plate to which both the waist belt and connecting elements for connection to the shoulder straps are sewn. The connecting elements may in particular be webbing and/or loops to which the shoulder straps are attached.

The back plate provided in addition to the load node can in particular be designed as described above, i.e. it can in particular be a back plate which is adapted three-dimensionally to the shape of the back and/or extends from a pelvic region to a shoulder region.

According to a possible embodiment of the present disclosure, provision is made for that the back plate is the only stiffening element of the carrying rack for vertical stiffening of the carrying rack between the pelvic region and the shoulder region. In particular, this makes it possible to dispense with a frame structure for the carrying rack and/or vertical braces. This increases comfort and reduces weight. This is possible in particular due to the load application at the lower end or in the region of the load node of the carrying rack.

According to a possible embodiment of the present disclosure, provision is made for that the back plate is made of plastic and/or is enclosed in a textile cover. By being made of plastic, the shape of the back plate can be easily provided, for example, by deep drawing, by building it up in a mold as a fiber composite part and/or by injection molding.

However, the configuration as a shaped part also means, irrespective of the method of manufacture, that the shape of the back plate adapted to the shape of the back in the horizontal and vertical directions results from the manufacture of the back plate and is imprinted in the material of the back plate so that it retains this shape at least in the absence of external forces. In particular, the shaped part is designed to be inherently rigid.

According to one possible embodiment, the shaped part has a substantially constant thickness over its entire extension. In particular, the thickness preferably varies by a maximum of 50% of the maximum value, further preferably by a maximum of 20% of the maximum value. The thickness is measured along a normal to the surface.

According to one possible embodiment, the shaped part is sewn to textile elements, for example to a textile cover and/or belt elements. The yarn used for the stitching preferably passes through the material of the molded part.

According to a possible embodiment of the present disclosure, provision is made for that the back plate comprises at least two beads extending in the vertical direction and formed in the direction of the load carrier, which beads serve as a stop for the load carrier.

According to a possible embodiment of the present disclosure, provision is made for that the beads each comprise at least one recess on their rear side facing the load carrier, in which a stop element arranged on the load carrier engages. The recesses and stop elements thus secure the load carrier against lateral slipping. The stop elements can, in particular, taper in the direction away from the load carrier and, in particular, be conical.

According to a possible embodiment of the present disclosure, provision is made for that a rear side of the beads facing the load carrier forms a flat surface against which the load carrier rests.

According to a possible embodiment of the present disclosure, provision is made for that the back plate comprises a bead formed away from the back and extending vertically preferably along the spine. The vertically extending bead increases the stiffness in the vertical direction. If it is formed along the spine, the wearing comfort is also increased.

According to a possible embodiment of the present disclosure, provision is made for that the back plate has a corrugated structure with corrugation crests and corrugation valleys extending in the horizontal direction. This increases stiffness in the horizontal direction and improves ventilation.

According to a possible embodiment of the present disclosure, provision is made for that the back plate comprises padding of uniform thickness over its entire extent on the side facing the back of the wearer. The padding regions of different thicknesses used in the prior art to adapt to the shape of the back can be dispensed with by the configuration as a shaped part.

According to a possible embodiment of the present disclosure, provision is made for that the back plate protrudes backward in the region of its upper end.

According to a possible embodiment of the present disclosure, provision is made for that the back plate comprises two incisions at its upper edge through which the shoulder straps of the carrying rack pass.

According to a possible embodiment of the present disclosure, provision is made for that the incisions extend into an area adapted to the shape of the back.

According to a possible embodiment of the present disclosure, provision is made for that the portions of the back plate remaining laterally of the incisions project rearwardly at their upper end away from the spine. This facilitates a connection of a load at the upper end of the back plate.

In particular, the connection elements and especially the loops for connection in the area of the upper end are arranged on the sections of the back plate remaining at the sides of the incisions, especially on their upper edge.

According to a possible embodiment of the present disclosure, provision is made for that the connection elements and, in particular, the loops for connection in the region of the upper end and/or strap members for lateral connection are directly connected to the back plate, in particular sewn, riveted and/or glued.

According to a possible embodiment of the present disclosure, provision is made for that the shoulder straps are arranged on the carrying rack so as to be adjustable in height relative to the back plate. In particular, this is done as already described above.

According to a possible embodiment of the present disclosure, provision is made for that the load carrier is formed by an intrinsically rigid carrying element taking the weight of the item of equipment in vertical direction. In particular, the load-bearing element is configured in such a way that it can absorb the loads due to the item of equipment which is fastened to it, and transfer them in a self-supporting manner to the connection elements arranged in the region of the lower end.

According to a possible embodiment of the present disclosure, provision is made for that the load carrier comprises a carrying plate.

According to a possible embodiment of the present disclosure, provision is made for that the carrying plate is sewn into a fabric pocket and/or is made of an aluminum-plastic layered material.

According to a possible embodiment of the present disclosure, provision is made for that the connection elements and, in particular, the loops are preferably sewn to the fabric pocket.

According to a possible embodiment of the present disclosure, provision is made for that the carrying plate comprises a plurality of recesses at which at least one stop element is arranged or can be arranged on the side facing the carrying rack and/or at least one clamping element and/or at least one positioning element is arranged or can be arranged on the side facing away from the carrying rack.

According to a possible embodiment of the present disclosure, provision is made for that the stop elements, positioning elements and/or tensioning elements are further preferably screwed and/or bolted to the carrying plate.

According to a possible embodiment of the present disclosure, the load carrier that can be detachably connected to the carrying rack is configured as a backpack element, in particular as a textile bag.

The carrying rack thus makes it possible to attach different load carriers depending on the intended use. In addition to changing between a load carrier with a carrying plate and a load carrier in the form of a backpack element, different sized backpack elements can also be attached.

The load carrier configured as a backpack element can also be configured as a slack element that is suspended from the carrying rack. Alternatively, the load carrier configured as a backpack element can also have vertical stiffening members and/or be configured to be inherently rigid. This is particularly advantageous for larger backpack elements.

Even though the carrying rack has therefore been described with regard to the first aspect in combination with an inherently rigid load carrier, the same embodiment of a carrying rack can also be used with other, in particular non-inherently rigid load carriers, in particular also those in which the load application does not occur at least predominantly at the lower end and/or at the upper end.

In one possible embodiment, the carrying rack represents an independent element, which as such can be carried by a person in the manner of a backpack. The load carrier according to the disclosure can be detachably attached to this carrying rack.

In one possible embodiment, the system is configured such that the item of equipment is only indirectly held on the carrying rack via the connection of the load carrier to the carrying rack.

In one possible embodiment, the equipment item and/or the positioning element(s) and/or the tensioning element(s) are connectable to the load carrier while the load carrier is not yet connected to the carrying rack.

In one possible embodiment, the load carrier is releasably connectable to the carrying rack in a state in which the item of equipment and/or the positioning element(s) and the clamping element(s) are already connected to the load carrier.

In one possible embodiment, the at least one clamping element and/or the at least one positioning element are directly connected, in particular screwed, to the carrying plate of the load carrier, while the at least one clamping element and the at least one positioning element are not directly connected to the carrying rack, but only indirectly via the connection of the load carrier to the carrying rack.

The present disclosure further comprises a carrying rack of a carrying system as described above. The carrying rack is configured as already described above with respect to the carrying system. In particular, it has the connection elements and/or loops according to the disclosure.

The present disclosure further comprises a load carrier of a carrying system as described above. The load carrier is configured as already described above with respect to the carrying system. In particular, it comprises the connection elements and/or loops according to the disclosure.

The present disclosure will now be described in more detail with reference to drawings and examples of embodiments.

DETAILED DESCRIPTION

The different aspects of the present disclosure are described below with reference to an embodiment of a carrying rack to which a load carrier can be detachably attached. However, the carrying rack can also be used identically as an integral part of a backpack by sewing a backpack bag to the carrying rack. Furthermore, instead of the load carrier shown in the embodiment of the carrying system in the form of a carrying plate, a backpack element can be detachably connected to the carrying rack as a load carrier.

Further, the different aspects of the present disclosure are all realized in combination in the embodiment. However, the details described with respect to the individual aspects can also be used independently of this overall context for further development of the respective aspects and without the features of the other aspects.

Figure 1:
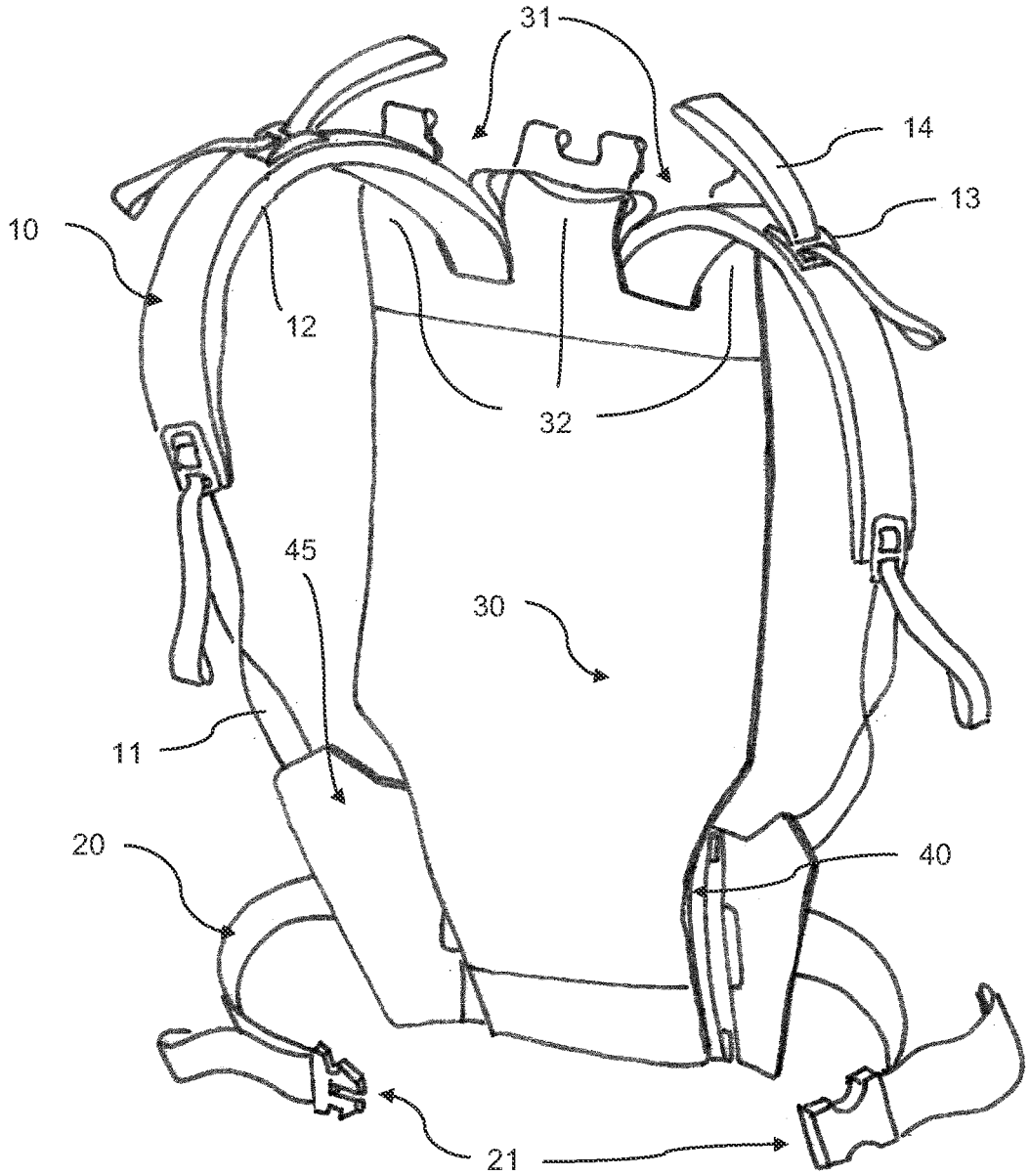
FIG. 1 an exemplary embodiment of a carrying rack according to the disclosure in a perspective view from diagonally in front, FIG. 2 the exemplary embodiment of FIG. 1 in a perspective view from diagonally behind, FIG. 3 the exemplary embodiment of FIGS. 1 and 2 in a first partial sectional view A-A and a second partial sectional view B-B of the view from the front shown in the center, the two sectional views showing the carrying rack with shoulder straps adapted to differently sized carriers and set at different heights, FIG. 4 a detailed view of the load node of the embodiment in an oblique rear view, FIG. 5 a detailed view of the load node of the embodiment in an oblique front view, FIG. 6*a* a first exemplary embodiment of a carrying system according to the present disclosure, formed by the exemplary embodiment of a load carrier according to FIGS. 1 to 5 and a first exemplary embodiment of a load carrier in the form of a carrying plate, FIG. 6*b* a second exemplary embodiment of a load carrier in the form of a carrying plate, FIG. 6*c* a second exemplary embodiment of a carrying system according to the present disclosure, formed by the exemplary embodiment of a load carrier according to FIGS. 1 to 5 and a third exemplary embodiment of a load carrier in the form of a backpack element, FIG. 7 a detailed view of the connection of a further element to the load carrier of FIG. 6, FIG. 8*a* a sectional view and a perspective view of the first embodiment of a carrying system shown in FIG. 6*a*, wherein only the back plate and the load node of the carrying rack and the carrying plate of the load carrier with the respective connection elements are shown, FIG. 8*b* two sectional views and perspective views of a further embodiment of a carrying system in which the load carrier according to FIG. 6*b* is used, the left and right views showing two different vertical positions in which the load carrier can be attached to the carrying rack, FIG. 9 an alternative exemplary embodiment of a carrying system in which a differently configured back plate of the carrying rack is used, FIG. 10 the first step for attaching waist strap padding elements, in which a stiffening member is attached to the carrying rack, FIG. 11 the second step for attaching waist strap padding elements, in which the waist strap padding elements are pushed onto the stiffening member, FIG. 12 the third step for attaching waist strap padding elements, in which a rod is pushed through a loop of the waist strap pushed through a slot of the stiffening member and loops on the waist strap padding elements, FIG. 13 the exemplary embodiment of the carrying rack according to the disclosure in a perspective view from diagonally in front with attached waist strap padding elements, and FIG. 14 an embodiment of a carrying system according to the disclosure with a load carrier in the form of a carrying plate with tensioning straps and positioning elements.

FIG. 1 shows the main components of an embodiment of a carrying rack according to the present disclosure.

The carrying rack comprises shoulder straps 10 and a waist strap 20, via which it can be worn on the body. The shoulder straps comprise shoulder pads 12 and strap members 11, which are attached to the shoulder pads 12 via buckles in a length-adjustable manner. The waist strap includes a buckle 21, via which the waist strap can be closed on the front of the wearer.

Also shown is a back plate 30 and a load node 40 with wings 45 arranged behind it in the lumbar region, to which the lower ends of the strap members 11 are attached. Attached to the load node, as will be described in more detail below, are the waist strap 20 and the rear ends of the shoulder straps 10. Notches 31 are provided on the upper edge of the back plate 30 through which the shoulder straps 10 pass.

Furthermore, lashing straps 14 are shown, which are arranged on buckles 13 to be adjustable in length on the shoulder pads 12.

However, the aspects of the present disclosure described below do not necessarily utilize all of the main components of the embodiment just described and, therefore, are also applicable to carrying racks which include only the respective main components involved and are otherwise constructed differently.

1. Back Plate

According to one aspect of the disclosure, the carrying rack uses as the back plate 30 a shell made of plastic, which is adapted to the shape of the human back, and which is preferably sewn into a textile bag. In this case, the adaptation to the shape of the human back takes place in the vertical and horizontal directions, so that the back plate is shaped three-dimensionally.

Figure 2:
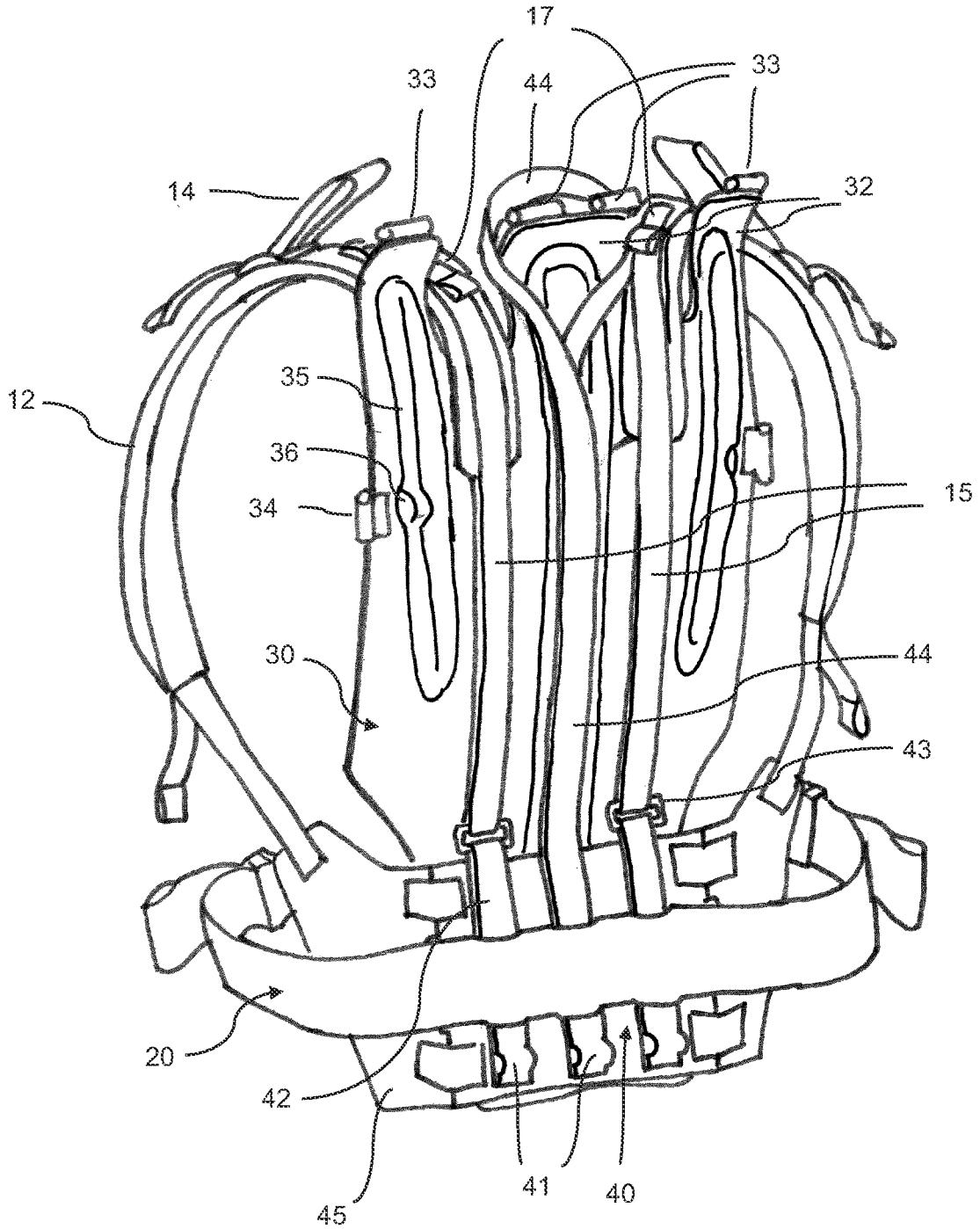
Figure 8A:
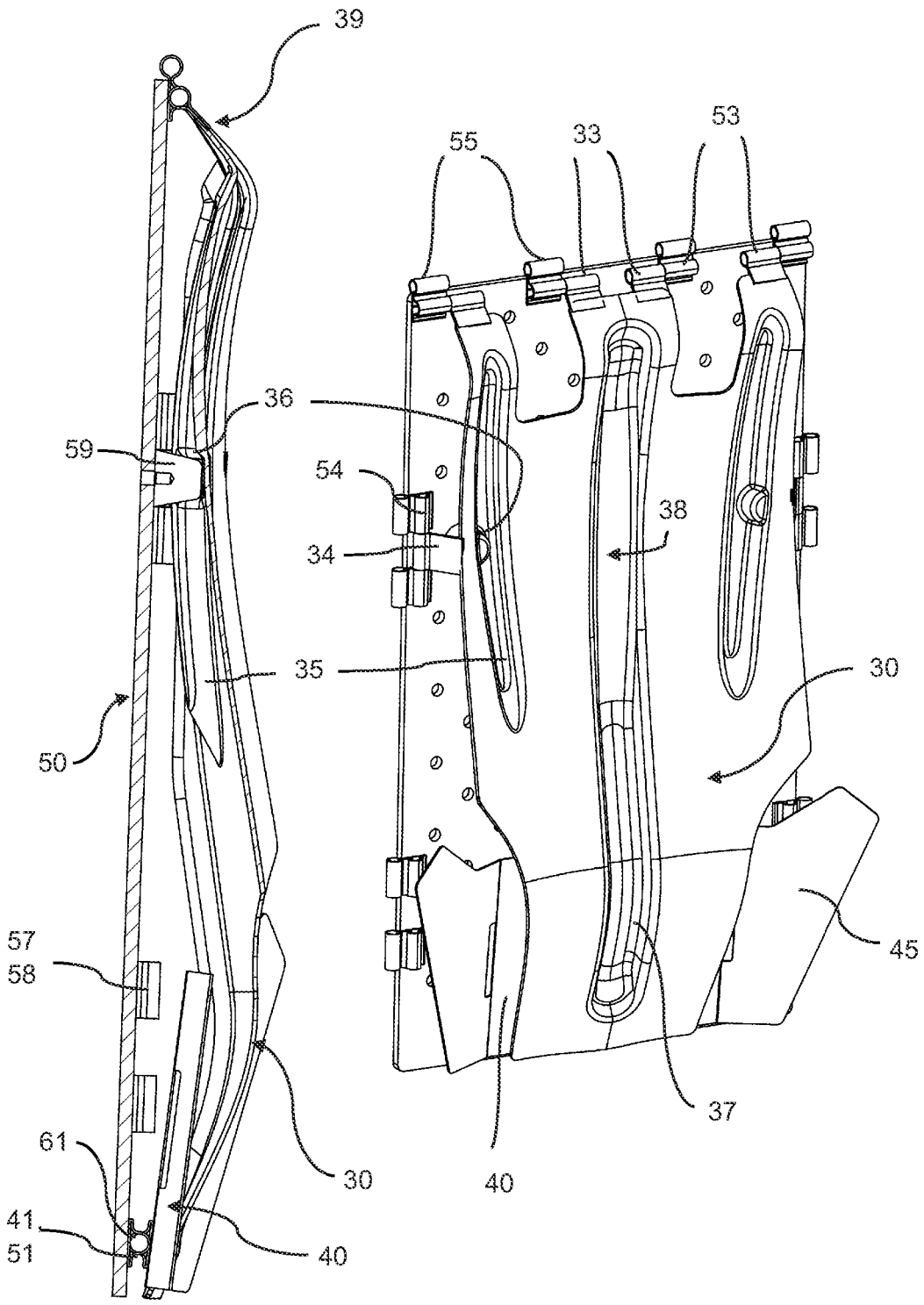
Figure 8B:
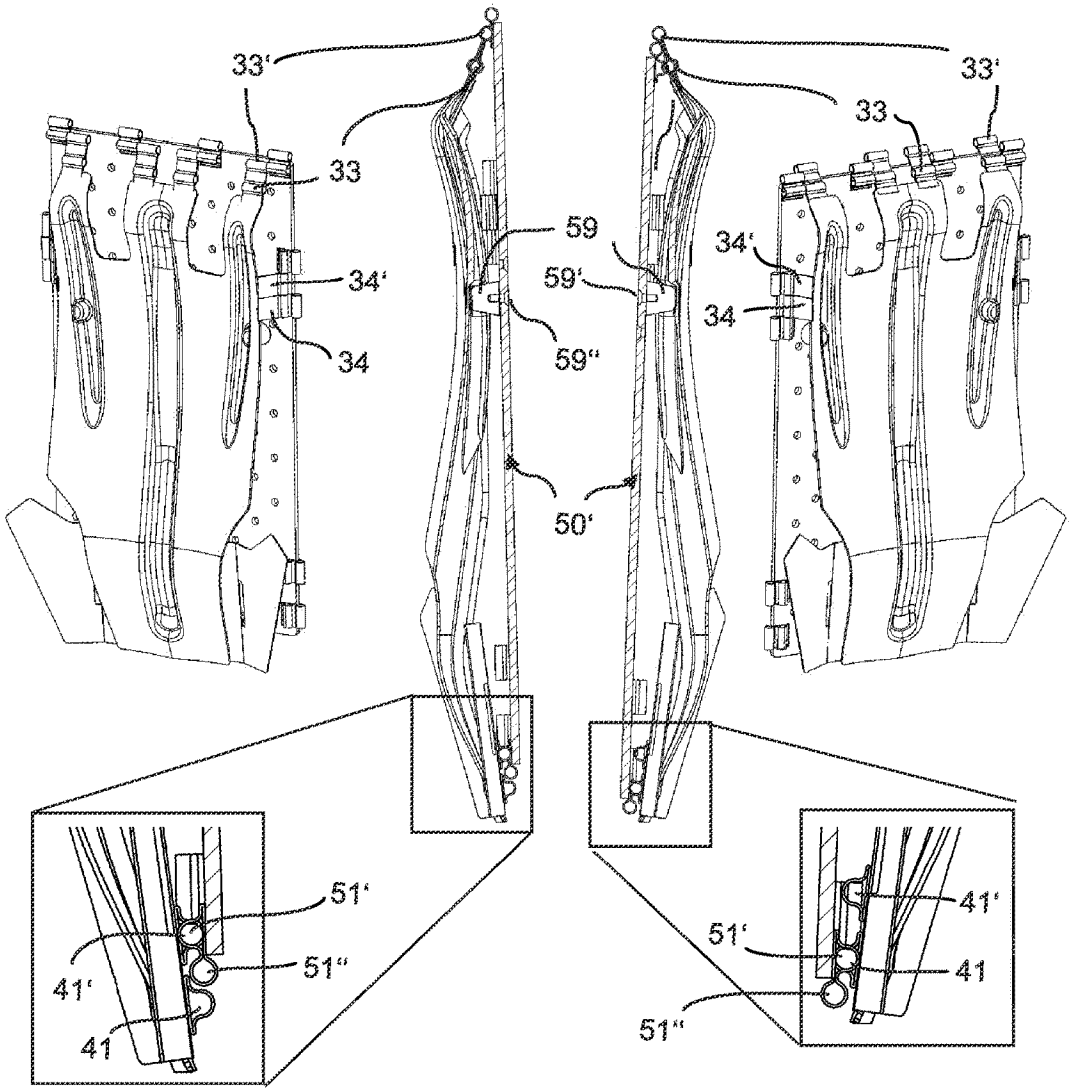
Figure 9:
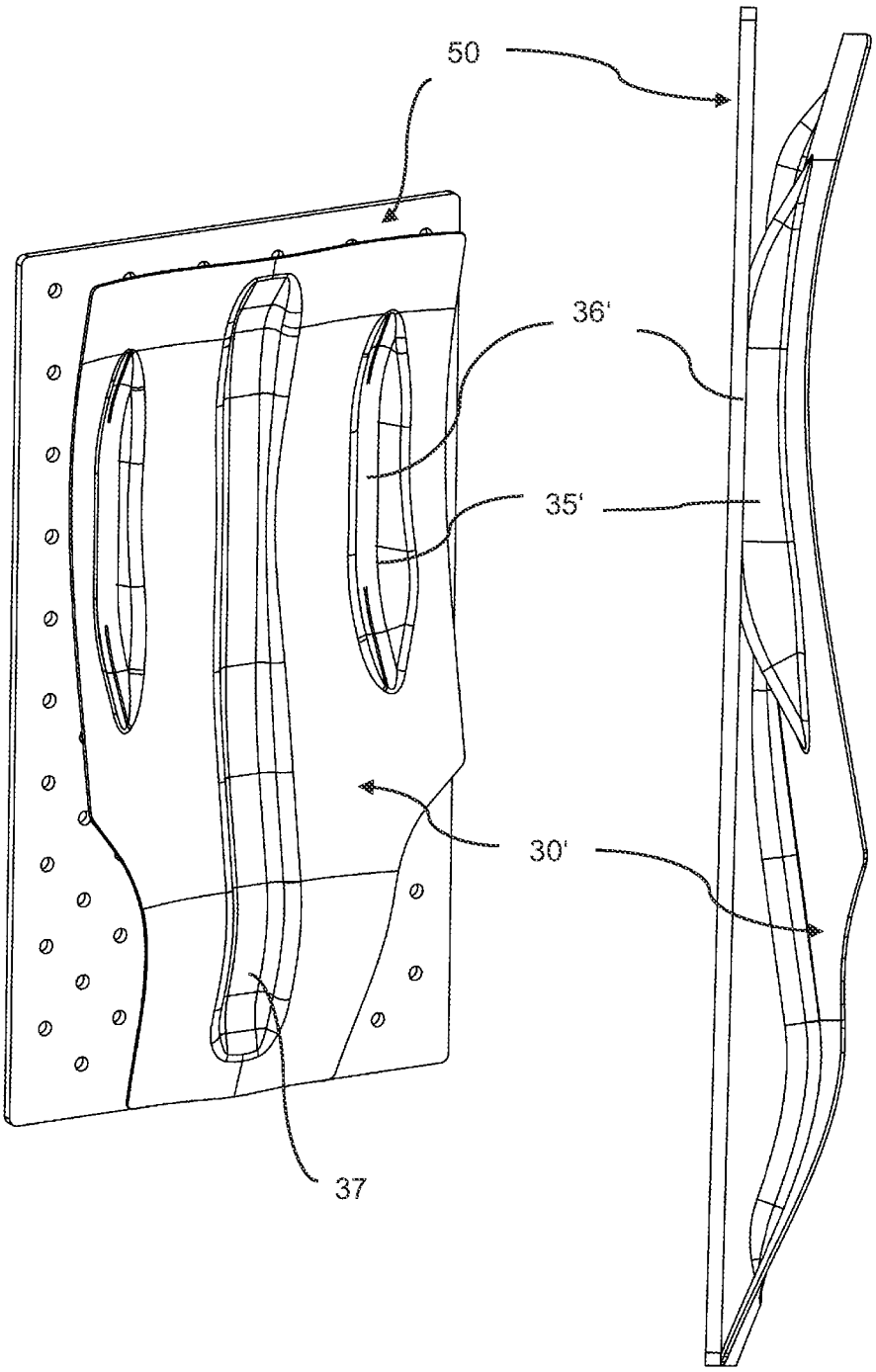

Therefore, as can be seen in FIG. 2 and FIGS. 8 and 9, in the lumbar region, the back plate 30 has a shape that is convex in the vertical direction and concave in the horizontal direction when viewed from the front. In contrast, in the upper back region, the back plate 30 has a shape that is concave in both the vertical direction and the horizontal direction, as viewed from the front.

In accordance with another aspect of the disclosure, the back plate 30 extends along the entire vertical height of the carrying rack.

The shape of the back plate 30 allows padding of the same thickness to be used throughout, for example padding 1 cm thick. In the prior art, on the other hand, it was necessary to use multiple thicknesses of padding and padding of large thickness in order to adapt the backpack to the back of the wearer.

The back plate 30 is therefore configured as a shaped part which can be formed, for example, from a plastic plate by means of a thermoforming process. Preferably, the plastic plate has a thickness which still allows the back plate to be sewn to other elements.

In the embodiment, as shown in FIGS. 8 and 9, the back plate 30 has a rearwardly projecting bead 37 extending in the vertical direction and centered in the region of the wearer's spine. This increases the stiffness in the vertical direction and increases the comfort of the wearer. The bead 37 extends over at least 80% and preferably 90% of the vertical height of the back plate 30.

In the embodiment, the shaped part comprises a wave pattern whose wave crests extend horizontally, stiffening the shaped part in the horizontal direction. This is not shown in the drawings.

In the embodiment, the back plate 30 further comprises, as can be seen in FIG. 2 and FIGS. 8 and 9, in the region of the upper back two beads 35 extending in the vertical direction and arranged to the right and left respectively and projecting to the rear. These also stiffen the shaped part in the vertical direction and serve as a contact surface for the load carrier 50, which can be detachably connected to the carrying rack.

According to the alternative embodiment shown in FIG. 9, the beads 35' of the back plate 30' serve as a contact surface for a carrying plate of the load carrier 50, and therefore have, at least in a partial area, a straight rear surface 36' against which the carrying plate 50 can rest.

In the embodiment described in the other figures, the details of which are best seen in FIG. 8*a*, the beads 35 also existed because they increase the stability of the shaped part. However, it is not the rear sides of the corrugations that serve to position the load carrier 50 on the carrying rack, but rather two recesses 36 of the corrugations, which are let into the outer lateral edge of the corrugations 35 in particular, and in which stop elements 59 of the load carrier 50 engage in order to position the load carrier 50 uniquely with respect to the shaped part in both the lateral and vertical directions. The stop elements have, in particular, a conical shape. In contrast, there is no direct contact between the other elements of the load carrier 50 and in particular the carrying plate and the shaped part (except for the connection elements described below). In the exemplary embodiment, the stop elements 59 are fastened, in particular screwed, to openings 59, in particular bores, of the load carrier. As shown in the exemplary embodiment in FIGS. 6*b* and 8*b*, several vertically superimposed apertures 59' can be provided in order to be able to mount the stop elements 59 at at least two different heights.

The beads 35 therefore no longer must have a straight back and can be configured to be less deep.

The central vertical bead 37 has an area 38 in which it has a flat rear side which, when the load plate is mounted, extends parallel to the load plate at a predetermined distance. This configuration of this bead is intended to provide sufficient space for any screw nuts with which positioning elements are fastened to the load plate 50.

The central vertical bead 37 is flatter in the area 38 than in the area of the shoulders and pelvis. However, the lateral beads 35 extend parallel in area 38 and compensate for the stability lost as a result.

As already described, the shaped part can also be used identically for backpacks by sewing a bag onto the shaped part or the cover surrounding the shaped part. However, the lateral beads can also be dispensed with in a possible alternative embodiment.

2. Upper Edge of the Back Plate—Size Adjustment to the Person Wearing it

The back plate 30 comprises vertical recesses or slots 31 at its upper edge through which the shoulder straps 10 pass.

These recesses 31 extend into that region in which the shaped part 30 is adapted to the shape of the back of the carrier and therefore, as seen from the front, is concave at least in the vertical direction and preferably also in the horizontal direction.

Depending on the size of the wearer of the carrying system, the shoulder straps 10 therefore extend along the lower edge of these vertical incisions 31 as shown in FIG.

3 on the left (in the case of small wearers) or as shown on the right (in the case of larger wearers) in higher positions through the recesses 31 starting from the rear of the back plate 30 over into the shoulder of the wearer towards the front.

In this regard, the shoulder straps 10 are provided with shoulder pads 12, and therefore, since the shaped part 30 is directly against the back of the wearer, should not begin until they are actually around the shoulders of the wearer.

Therefore, the position of the shoulder straps 10 can be changed in the vertical direction with respect to the back plate 30.

Figure 3:
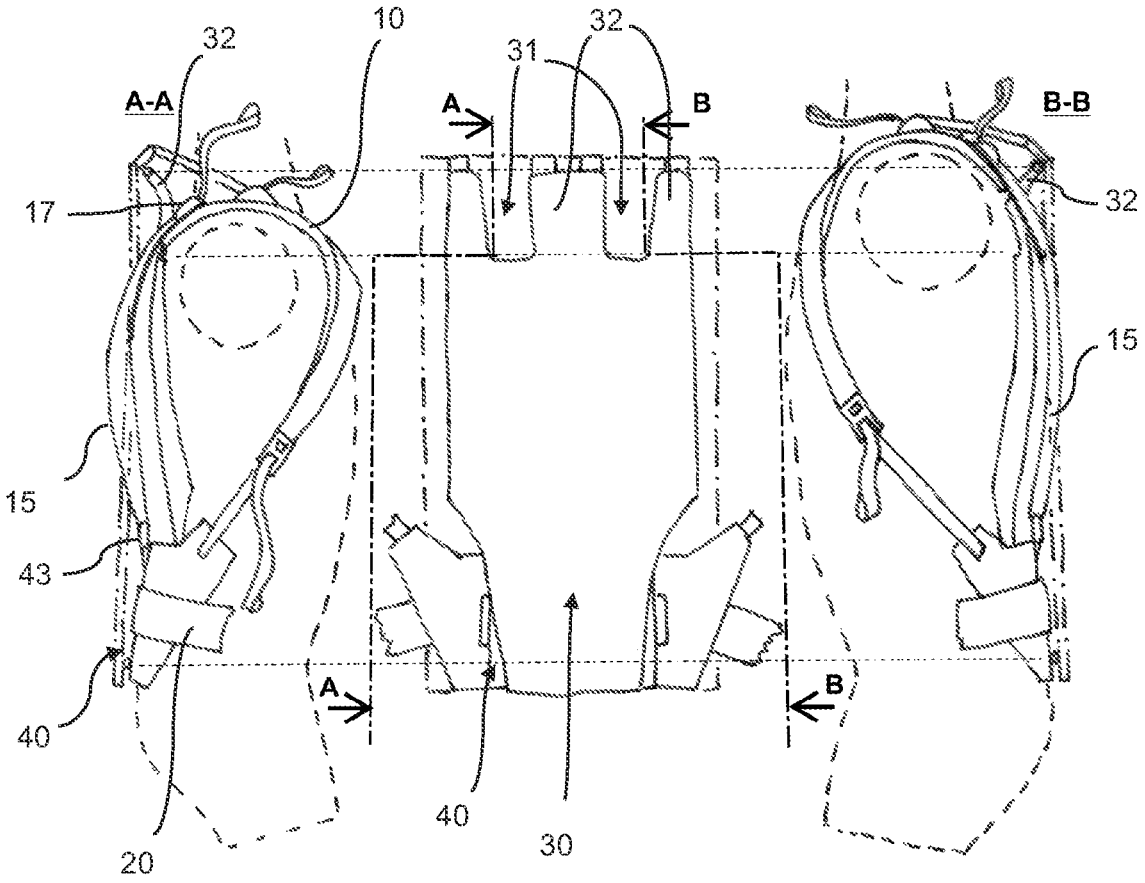

This is effected in that, as can be seen in FIGS. 2 and 3, strap members 15 of the shoulder straps 10 pass through corresponding buckles 43 of the load node 40 described in more detail below. From there, the strap members 15 are guided in the form of a loop back to the shoulder area of the shoulder straps 10, where they are fastened in a length-adjustable manner by buckles 17. By adjusting the size of this loop by adjusting the length of the strap members 15, the height at which the shoulder pads 12 of the shoulder straps 10 are arranged can also be adjusted. The adjustment option is particularly easy to handle due to the arrangement on the shoulder straps.

This is of particular importance with regard to the shaped part 30 used in accordance with the disclosure, since this extends continuously from the waist area to the shoulder and therefore restricts access to the corresponding belt or carrying system in this area. Guiding the straps 15 from the shoulder area along the back of the shaped part 30 to the load node 40 in the pelvic area and back again in the form of a loop nevertheless allows the height of the shoulder pads 12 to be adjusted relative to the shaped part 30, wherein the adjustment facility is provided in the shoulder area for easy access.

However, unlike in the exemplary embodiment, the buckles 43 for deflection would not have to be arranged directly at the load node, but could also be positioned higher up via straps arranged at the load node.

The adjustment option is particularly applicable when the carrying rack is used with a backpack where the back of the back plate is not accessible.

As can be seen in FIG. 2, a webbing loop 44 is also attached to the load node, which extends to the upper end of the carrying rack and serves as a handle for carrying the carrying rack with one hand. In this case, the two sides of the loop 44 are guided forward through the incisions 31 at the upper edge of the back plate 30, so that the loop grips around the central element 32 of the back plate extending between these incisions 31.

3. Load Node

Figure 4:
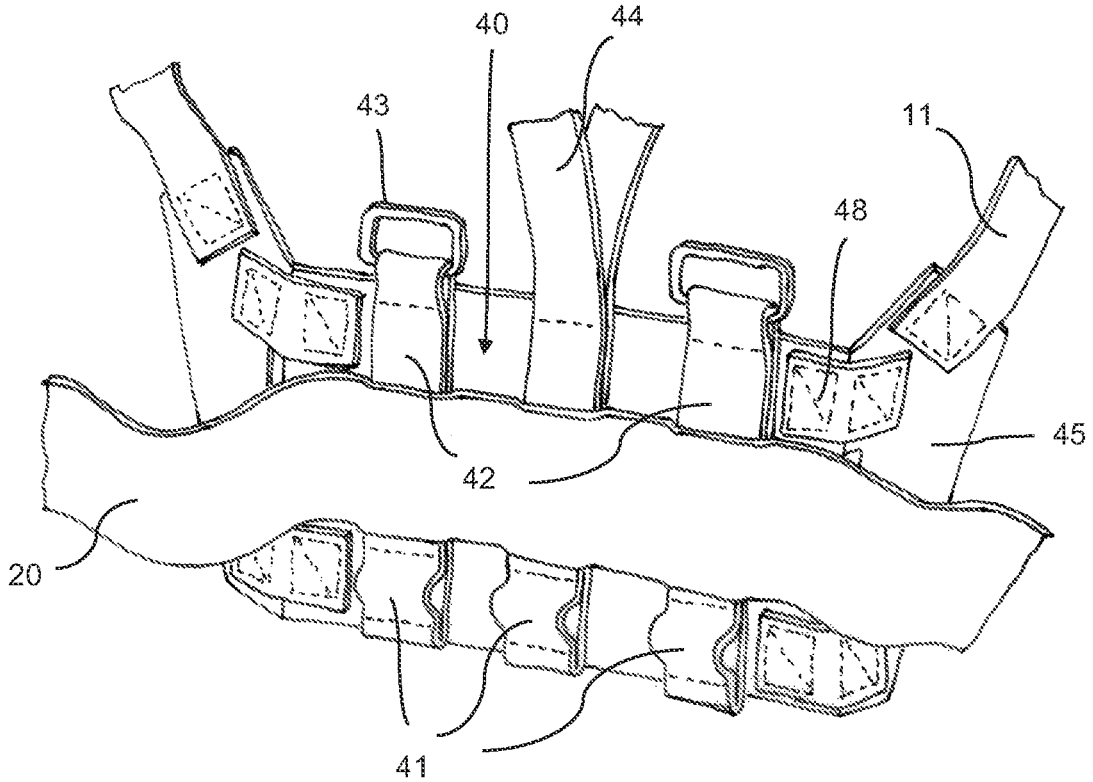
Figure 5:
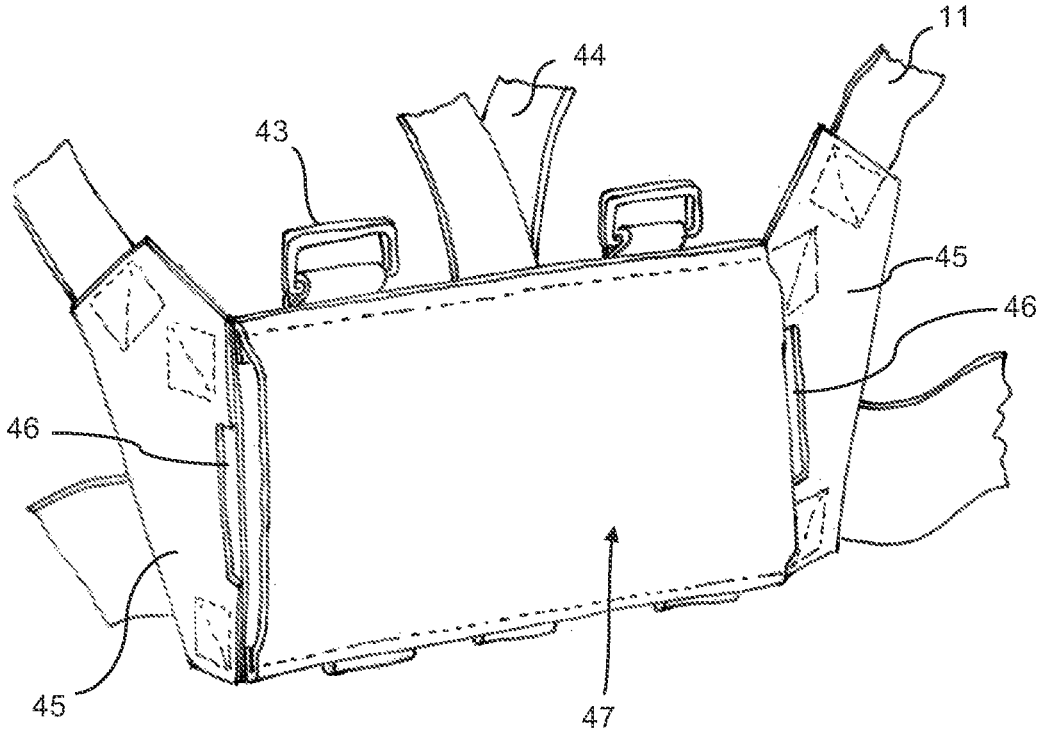

Another basic element of the carrying rack (possibly in addition to the back plate described above) is a load node 40, which is located in the area of the waist strap and is shown in FIGS. 4 and 5.

This is a preferably square reinforcement plate to which the waist strap 20 of the carrying rack is fastened and in particular sewn on in the horizontal direction. The reinforcement plate can be made of plastic and/or be arranged in a textile cover.

According to a possible aspect, connection elements 41, in particular in the form of textile loops, are provided at the load node 40, via which the load carrier 50 is connected to the carrying rack. In particular, the connection elements 41 are sewn to the reinforcing plate.

According to another possible aspect, straps 15 for the shoulder straps 10 of the carrying rack engage the load node 40 in the vertical direction. For this purpose, buckles 43 are arranged at the load node 40 through which the straps 15 extend.

In the exemplary embodiment, the loops 41 are formed by vertically extending strap members which are sewn to the load node 40. In the exemplary embodiment, loops are provided at their upper end to which the buckles 43 for the shoulder straps are attached. The straps for the belt loop 44 are also sewn to the load node and form a connection element 41.

The connection elements 41, in particular in the form of sewn-on loops, are preferably provided on the rear side of the load node in a lower region, in particular in the region of the lower edge.

The waist strap 20 is attached to the load node in the horizontal direction and, in particular, is sewn to the reinforcement plate 40 and the webbing extending thereon in the vertical direction.

In the exemplary embodiment in FIG. 4, the connection elements 41 are arranged below the waist strap 20 at the load node 40.

In an alternative exemplary embodiment of a load node as used in FIG. 8*b*, at least two connection elements 41, 41' arranged vertically at different heights can be provided on the load node. In particular, in the exemplary embodiment shown in FIG. 4, additional connection elements 41' can be arranged on the load node in the area of the waist strap or above the waist strap 20. These can also be formed by the vertically extending strap members, which also form the loops 41

In the exemplary embodiment, the connection elements 41 or 41' are formed by several textile loops arranged horizontally next to each other and aligned with each other.

At the load node 40, wing-like plates 45 are arranged on both sides, to which the lower ends of the strap members 11 of the shoulder straps 10 are sewn.

In the exemplary embodiment in FIGS. 4 and 5, the wings 45 are arranged via textile hinges 48 in the form of sewn-on strap members on the load node and, in particular, on the reinforcement plate of the load node. Between the hinges 48, recesses 46 are provided in the wings, which provide a slot-like opening between the load node 40 and the wings 45, the function of which will be explained in more detail below. In an alternative embodiment, the load node 40 and the wings 45 are formed by a continuous reinforcing plate which has apertures in the region of the hinges which provide the hinge function. In particular, the recesses 46 may also be provided here, which provide a slot-like opening between the load node 40 and the wings 45, while in that region in which the textile hinges 48 are provided in the first exemplary embodiment, the reinforcing plate connects the load node 40 and the wings 45. Further apertures may be provided here, if necessary, to increase the flexibility of the reinforcing plate in this region.

A textile pocket 47, open on both sides, is attached to the front side of the load node 40 and sewn to the load node, particularly at the upper edge and lower edge.

The back plate 30, in particular in the form of a shaped part that mimics the course of the wearer's back, is sewn, for example, over its textile cover to the lower edge of the load node 40, and then folded over upward so that it extends upward on the body side in front of the load node 40.

4. Connection of a Load Carrier

The detachable connection of a load carrier 50 to the carrying rack is shown in more detail in FIGS. 6*a* and 6*c* and 8*a*, 8*b* and 9. This realizes several aspects of the present disclosure.

In one aspect, the connection between the load carrier 50 and the carrying rack is established via connection elements arranged on both elements, which are connected by a connecting means 60 separate therefrom.

In the embodiment, the connection elements are loops 41, 51, in particular textile loops formed by webbing, through which a rod 61 is pushed as a connecting means 60. This is preferably a plastic rod.

A flexible band 62, particularly in the form of a loop, is attached to one end of the rod 61 and is pulled over the opposite free end of the rod 61 that protrudes from the loops to secure the connection.

Preferably, at least three loops are provided in each case, which are connected to each other by the rod and which are arranged alternately on the carrying rack and the load carrier 50. To connect the carrying rack and load carrier 50, they are positioned relative to each other so that the loops are aligned with each other, and the rod 61 is pushed through the loops. More than three loops, in particular 2n+1 loops, where n is an integer greater than 0, can of course be used to transfer greater loads.

The loops are preferably dimensioned so that the rod 61 is held in the loops with substantially no play. In particular, the inner diameter of the loop corresponds to the diameter of the rod 61.

As shown in FIG. 4 for the loops 41, these can be provided, for example, by sewing a webbing to a flat layer of material at two points spaced apart from one another in the longitudinal direction of the webbing, so that the webbing stands up in an arcuate manner between the seams to form a loop. As also shown in FIG. 4, two layers of webbing can be sewn to a flat layer for this purpose, with the lower layer of webbing resting on the flat layer and the upper layer projecting in an arcuate shape so that the loop is formed between the two layers of webbing. This configuration of the loops enables a particularly stable connection.

However, the loops can also be formed by sewing a webbing strap to itself, as is the case with the loops 33 on the upper edge of the carrying rack.

The connection via loops and a rod can also be used independently of a carrying rack or load carrier for other textile elements. Textile elements are considered to be all items which are at least partially formed by textile layers, for example plate carriers for ballistic plates, protective vests, backpacks or bags.

According to a further aspect, the load application of the load carrier 50 into the carrying rack takes place in the lower region of the carrying rack, in particular in a region which is not higher than 10 cm above the upper edge of the waist strap 20, in particular at the level of the waist strap 20 and/or below the waist strap 20, in particular in the region of the lower edge of the carrying rack.

Connection elements 41, 41' are provided for this purpose in this area, which are connected to connection elements 51, 51' of the load carrier 50.

As described above, this can in particular be textile loops through which a connecting rod is inserted. Here, the loops are arranged next to each other in the horizontal direction, so that the rod also passes through the loops in the horizontal direction.

As described above, the connection elements and in particular the loops 41, 41' are arranged at the load node 40.

In the embodiment, the connection elements 41, 51 and in particular the loops between the carrying rack and the load carrier 50 are positioned on the respective opposing main surfaces of these elements.

Figure 6A:
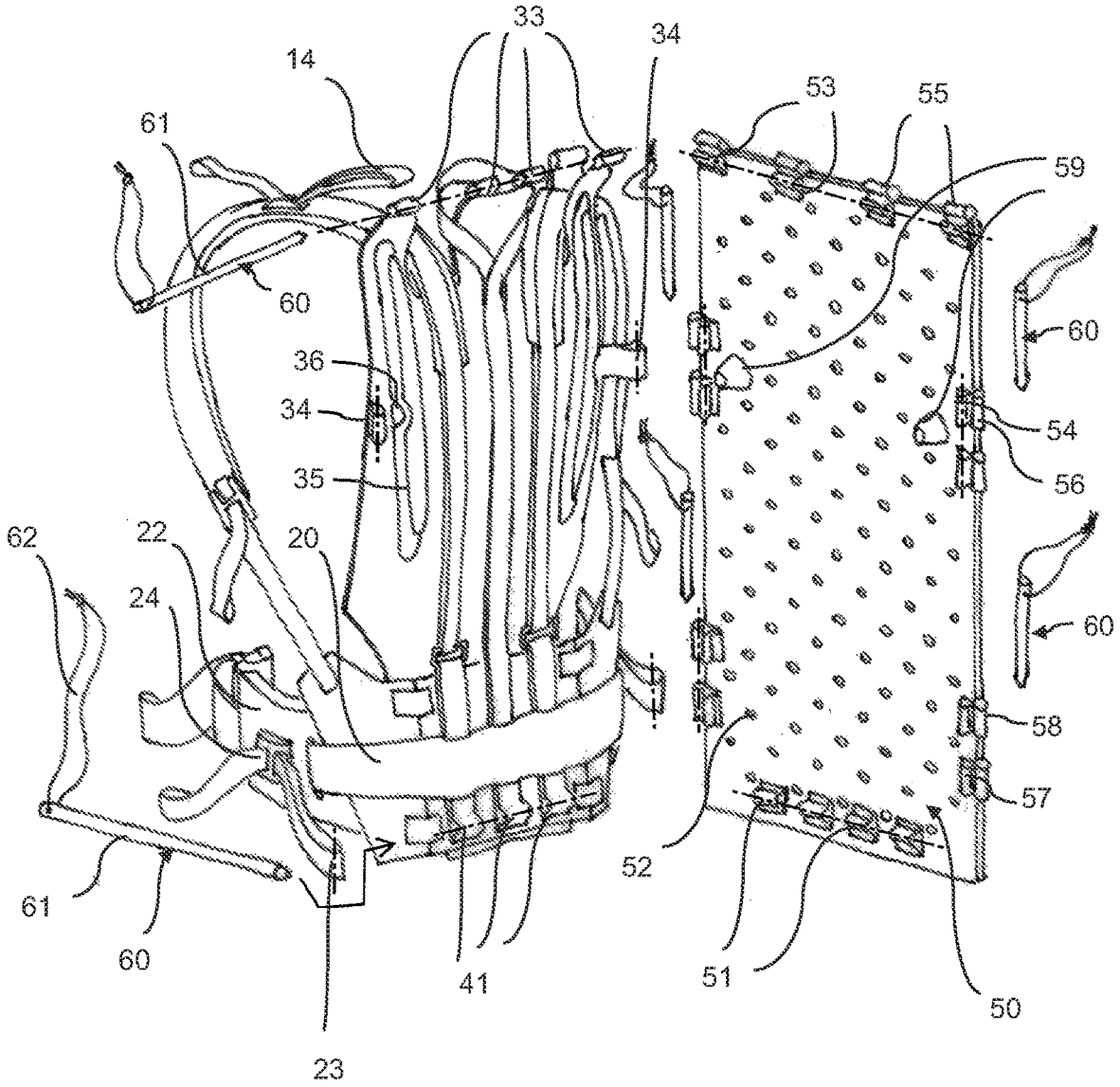

In the exemplary embodiment in FIGS. 6*a* and 8*a*, the connection elements 41, 51 and in particular the loops are positioned on both elements starting from the lower edge with a certain offset upwards.

Figure 6B:
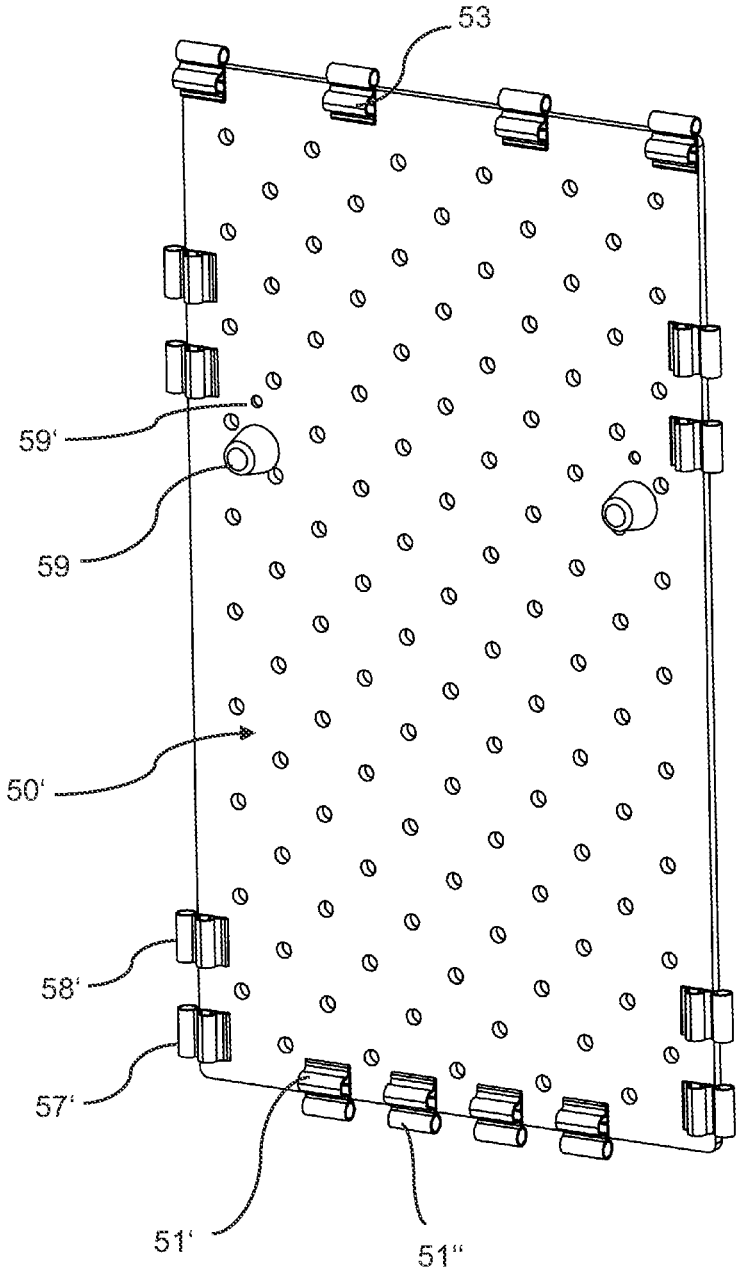

In the exemplary embodiment in FIGS. 6*b* and 8*b*, the connection elements 51' and in particular the loops are arranged on the load carrier 50' directly above the lower edge. On the load carrier, on the other hand, the connection elements 41' continue to be positioned starting from the lower edge with a certain offset upwards.

In accordance with one aspect of the disclosure, the load support 50 in FIGS. 6*a* and 6*b* is formed by a sufficiently inherently rigid carrying element that it can support the load of the piece of equipment attached thereto in the vertical direction even without external support and can therefore introduce this load into the connection elements 51, 51' with the carrying rack. In particular, the carrying element may be sufficiently inherently rigid to support items of equipment weighing up to 10 kg, preferably up to 20 kg, more preferably up to 30 kg.

Figure 14:
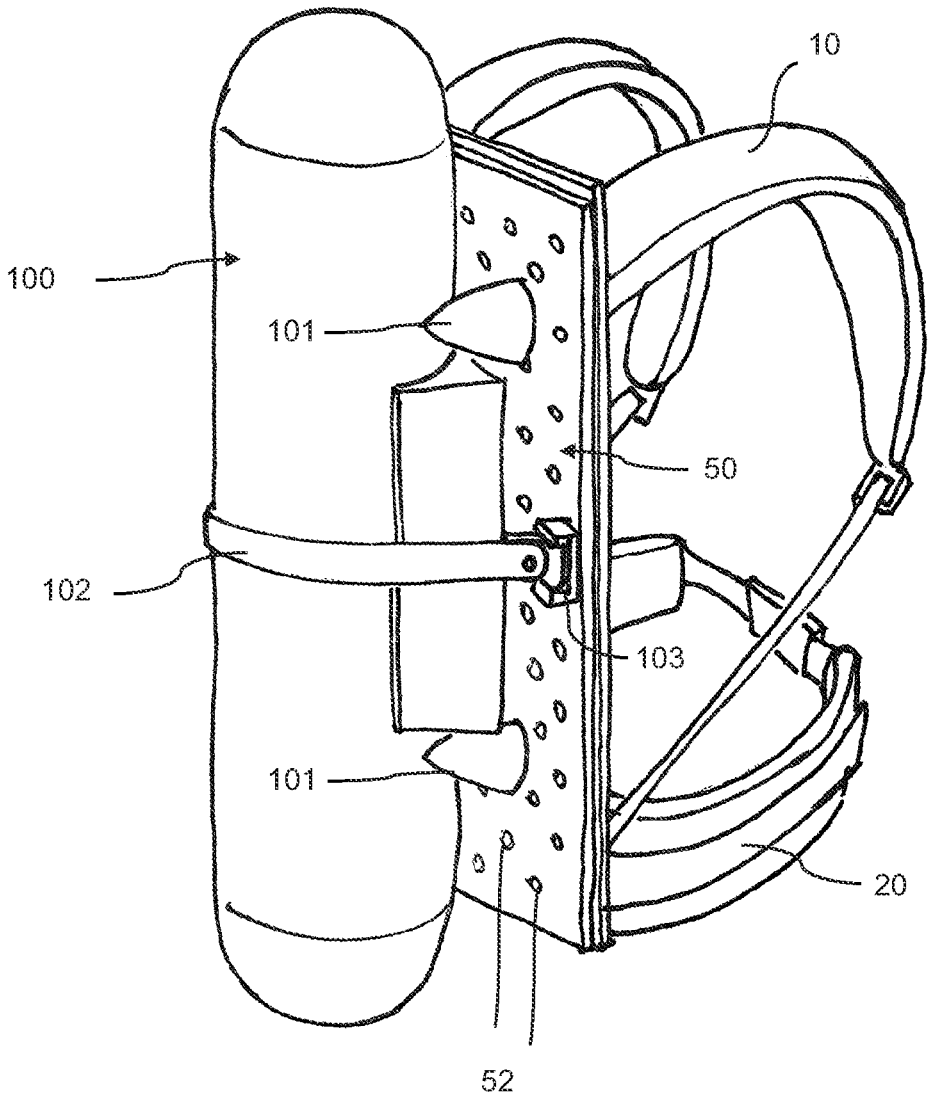

In particular, the load carrier 50, which is shown once again in FIG. 14 with an item of equipment 100 attached thereto, is a carrying plate which is made, for example, of a layered material of plastic and metal layers such as aluminum Dibond and is preferably sewn into a textile cover or fabric bag.

In the exemplary embodiment, the carrying plate 50 comprises a plurality of recesses 52, in particular in the form of apertures, to which clamping elements 102, 103 and positioning elements 101 shown in FIG. 14 can be attached, in particular by means of screw elements which pass through the recesses 50. The stop elements 59 already discussed above can also be attached to further recesses 59', in particular screwed on.

In the embodiment, the recesses in the carrying plate 50 are formed by holes 52, preferably with cutouts provided in the material of the fabric pocket that correspond to the holes, the cutouts preferably being cut out of the fabric by a laser.

In a possible embodiment, provision is made for that the carrying plate is connected and/or connectable to the shoulder straps via the fabric pocket.

Preferably, a plurality of positioning elements 101 are provided against which the item of equipment 100 can be braced by the clamping element 102, wherein the positioning elements 101 are arranged or arrangeable on both sides of the course of the clamping element 102, so that the item of equipment, in the braced state, bears against the positioning elements on both sides of the clamping element.

In a possible embodiment, provision is made for that the positioning elements 101 and the clamping element 102 are arranged or arrangeable in such a way that the load input into the carrying plate 50 is exclusively effected via the clamping element or elements 102 and the positioning elements 101. This achieves improved fixation and prevents wear on the carrying plate.

In a possible embodiment, provision is made for that the positioning elements 101 and the clamping element 102 are arranged or arrangeable such that the item of equipment is fixed by the at least one clamping element between positioning elements arranged on both sides of the clamping element 102 and on both sides of a main direction of the item of equipment 100 extending transversely to the clamping element 102.

Furthermore, an outer contour of the at least one positioning element may have a shape tapering in one direction and/or a rotationally symmetrical cross-section. This enables secure clamping with the positioning elements and the positioning elements can be used for any equipment.

In a possible embodiment, provision is made for that the outer contour of the at least one positioning element has a shape that tapers continuously in one direction, in particular a cross-section that tapers continuously in one direction.

In a possible embodiment, provision is made for that the outer contour of the at least one positioning element has a rotational symmetry, in particular an n-numbered rotational symmetry with n greater than or equal to 2, preferably greater than or equal to 3 or 6, and/or in particular a cylindrical symmetry. With an n-numbered rotational symmetry, the outer contour is mapped back into itself for each rotation through an angle of 360°/n or a multiple thereof. A regular hexagon therefore has, for example, a 6-count rotational symmetry. In a cylindrical symmetry, rotations by arbitrary angles map the outer contour back into itself.

In a possible embodiment, provision is made for that the one direction and/or axis of symmetry is perpendicular to the carrying plate and/or coincides with the longitudinal axis of a screw with which the positioning element is bolted and/or screwable to the carrying plate.

In a possible embodiment, provision is made for that the article of equipment 100 has a tapered shape in the region where it rests on a positioning element. In this case, the positioning element per se need not have a tapered shape to achieve the effect described above. The positioning element can, for example, have a flat upper side and/or a cylindrical shape.

In a possible embodiment, provision is made for that the one or more positioning elements and/or clamping elements are bolted and/or screwed to the carrying plate.

In a possible embodiment, provision is made for that a set screw is arranged on each of the positioning element(s) and/or clamping element(s) and is screwable to a nut provided on the rear side of the carrying plate facing the body of the support.

In a possible embodiment, provision is made for that an internal thread is arranged on each of the positioning element(s) and/or clamping element(s) and can be screwed to a screw whose head is provided on the rear side of the carrying plate facing the body of the support.

In a possible embodiment, provision is made for that the at least one tensioning element comprises a strap member 102 and a strap receiving element 103, wherein the strap member 102 is preferably made of plastic and/or comprises locking edges, and/or wherein the strap receiving element 103 preferably permits lashing of the strap member 102 and in particular comprises a tensioning ratchet.

In the embodiment, the carrying plate 50 has a regular hole pattern to which the clamping and/or positioning elements 101, 102, 103 can be attached in different arrangements depending on the item of equipment to be transported. However, a hole pattern specially adapted to a particular application could also be used.

Figure 6C:
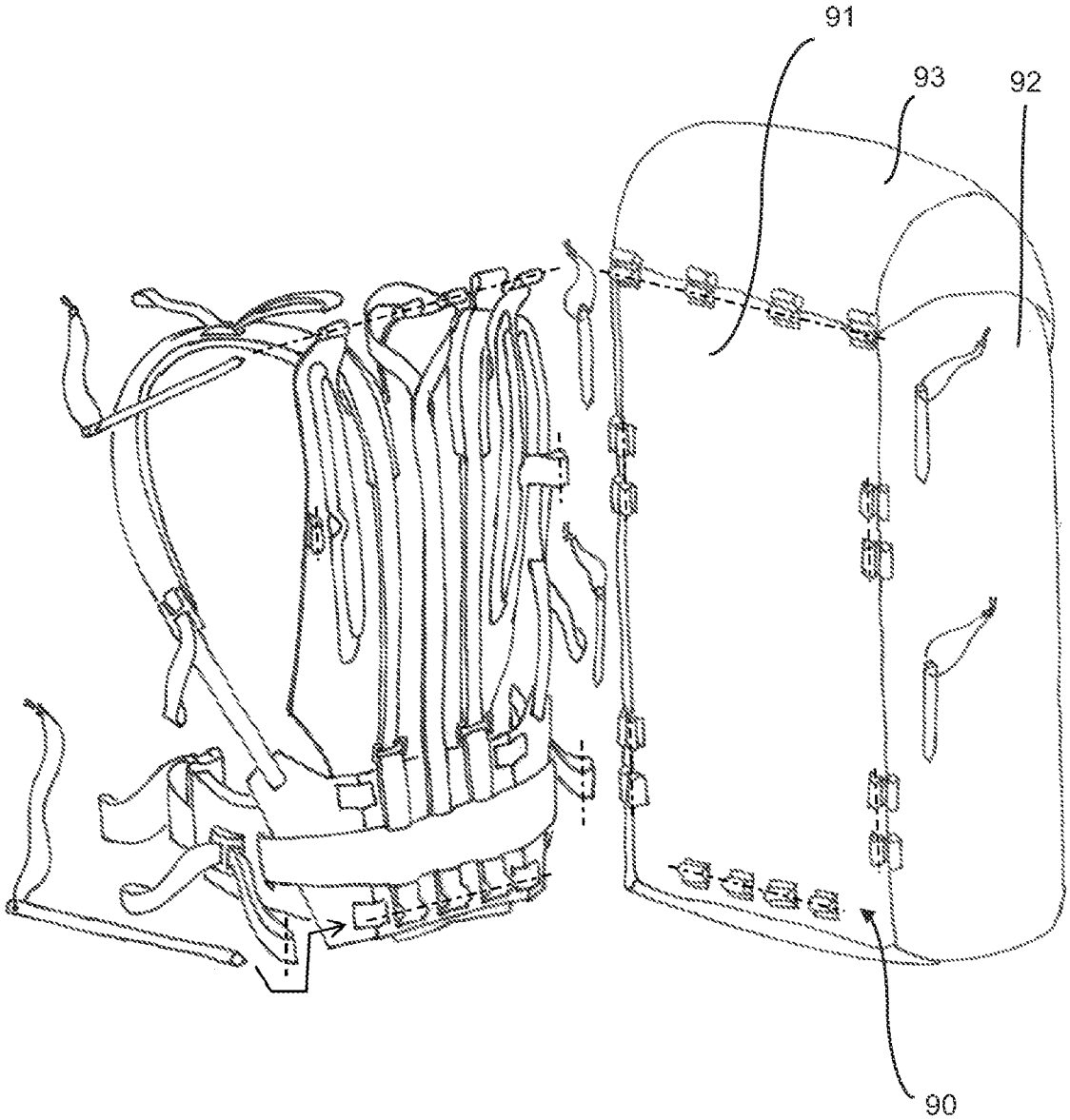

In the alternative use of the carrying rack shown in FIG. 6*c*, on the other hand, the load carrier 90 is not necessarily of inherently rigid configuration, but can also be formed by a slack textile element, for example. In this case, the load is not applied in the area of the lower end of the carrying rack as in the case of an inherently rigid load carrier, but the load carrier 90 is (also) suspended from the lateral and upper connection elements, which will be described below.

The load carrier 90 can be a backpack element as shown in FIG. 6*c*, which can be arranged on the carrying rack in exactly the same way as the inherently rigid load carrier in FIGS. 6*a* and 6*b*. For this purpose, the backpack element comprises a back element 91 on which the same connection elements are provided as on the inherently rigid load carrier 50 shown in FIG. 6*a*. In a possible embodiment, the back element can be formed by only one or more textile layers or elements. Alternatively, however, the back element 91 may comprise stiffening members such as vertical struts or a reinforcing plate. A textile bag 92 and an upper closure 93 are arranged on the back element.

In all exemplary embodiments, the load carrier is also connected to the carrying rack laterally and in an upper area in order to ensure sufficient stability during carrying. The stop elements described above may also contribute to this.

In a variant not shown, the carrying plate, which is sewn into a textile cover, could be connected to the carrying rack via zippers on the left and right sides.

In the exemplary embodiment, however, the connection is also established here via loops 34, 54 or 23, 57, which are connected via connecting means 60, in particular rods 61. This provides considerable advantages in terms of stability and durability.

In this embodiment, the lateral loops 34 are sewn to the back plate 30 and are connected to two loops 54 of the load carrier arranged above and below. The loops 34 are arranged on webbing straps and thus bridge the distance between the carrying rack and the load carrier 50.

In the exemplary embodiment, the lateral loops 23 are arranged on lashing straps, which are arranged on waist strap padding elements 22 in a length-adjustable manner, in particular via buckles 24. The lashing straps can alternatively also be attached to the waist strap in particular sewn thereto, and be adjustable in length via buckles. This is particularly advantageous in the case of a removable configuration of the waist strap padding elements 22, as will be described in more detail below. The lashing straps are preferably connected to two loops 57 arranged above and below the load carrier.

In the upper area, a connection is also established between the carrying rack and the load carrier 50 via corresponding connection elements 33, 53 for stabilization.

In the exemplary embodiment, the connection elements 33 are arranged at the upper edge of the back plate, in particular at the upper edge of the sections 32 of the back plate remaining on the inside and outside next to the incisions 31. These upper sections 32 project backwards in their upper region in this case, so that the load carrier can be attached to them.

Here as well, as at the bottom edge, the connection is made via corresponding loops 33, 53 and a connecting means 60, in particular a rod 61, which is pushed through them.

The loops 51,53, 54 and 57 are preferably sewn to a textile cover of a carrying plate serving as a load carrier or to the back element 91.

Two central aspects of the connection of the load carrier 50, 90 and in particular the carrying plate 50 or the backpack element 90 to the carrying rack are therefore the load application in the area of the lower edge, as well as the connection via textile loops and connecting rods which are pushed through them.

5. Connection of Further Elements

In one aspect, as in the embodiment, the carrying rack can be used to support a load carrier 50 and in particular a carrying plate.

The load carrier 50 may also comprise other elements attached to it in addition to the equipment held thereon, such as a backpack element or a cover for the equipment.

Figure 7:
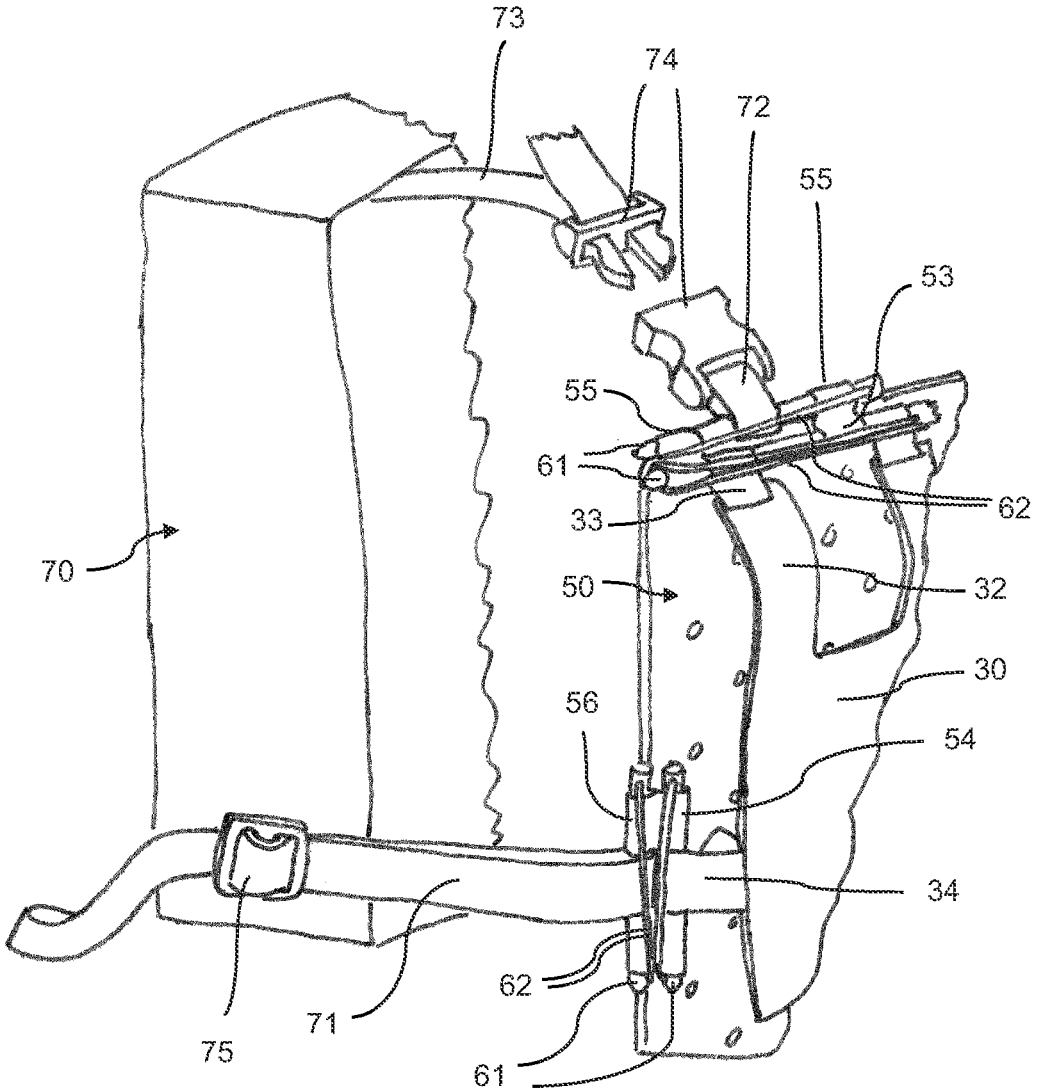

FIG. 7 shows the connection of further elements, such as a backpack element, to the load carrier 50. For this purpose, in addition to the connection elements for connecting the load carrier 50 to the carrying rack, further connection elements are provided for connection to the further element 70. In the exemplary embodiment, the further connection elements are also loops 55, 56, 58, which are connected via rods 61 to loops 71, 72 for connecting the further element 70.

In the exemplary embodiment, the loops 55, 56, 58 are arranged in horizontal and vertical directions, respectively, next to the loops 53, 54, 57 for connection with the carrying rack and are provided, in particular, by the same webbing, which forms two loops arranged next to each other by means of corresponding seams.

The loops 71, 72 for connecting the further element 70 can here be tied in the same way as the loops 34, 33 of the carrying rack to the rod 61 held by two loops of the load carrier on both sides.

In the exemplary embodiment, the loop 71 is formed by a webbing which is fastened to a buckle 75 of the further element 70 in a length-adjustable manner. The loop 72, on the other hand, carries an element of a buckle 74, the counterpart of which is attached to the further element 70 via a webbing 73.

Similarly, a cover could also be provided for equipment located on the load carrier 50.

If an inherently rigid load carrier 50 is not required, however, a backpack element 90 can alternatively be arranged on those connection elements on which the inherently rigid load carrier 50 is arranged according to the above description, as shown in FIG. 6*b*.

6. Multiple Vertical Connection Options Between Load Carrier and Carrying Rack

The lashing straps 14 extending from the shoulder straps 10 serve to stabilize the load carrier in the upper region and thereby engage the load carrier and/or carrying rack in the region of the upper edge, as can be seen in FIG. 3. In particular, as shown in FIGS. 6*a* and 6*c*, the loops formed by the lashing straps 14 can be attached to the rod 61 which serves to connect the load carrier to the carrying rack in the region of the upper end.

In order to provide effective lashing, the connection of the lashing straps to the carrying rack or the load carrier must not be arranged too low in relation to the shoulder straps. However, if the shoulder straps 10 are now changed in height relative to the carrying rack as described above and, in particular, moved upwards for use with larger carriers, this can result in an unfavorable angle for the lashing straps.

A first possibility would be to increase the height of the load carrier and, if necessary, to provide several connection options for the lashing straps at different vertical heights in the area of the upper end. However, this also increases the weight of the load carrier.

In the embodiment shown in FIGS. 6*b* and 8*b*, it is therefore possible to arrange the load carrier 50' in at least two different vertical positions, which are shown on the left and right in FIG. 8*b*. In the case of a larger carrier, in which the shoulder straps are arranged relatively high on the carrier frame, the higher of the two positions can therefore be selected for the load carrier.

On the load carrier 50' shown in FIG. 6*b*, the lower connection elements 51' in this embodiment are arranged immediately adjacent to the lower edge in order to provide the greatest possible distance from the upper connection elements 53. Furthermore, the lower connection elements 51' are manufactured and connected to the load carrier in the same way as the upper connection elements 53. In particular, the webbing straps by which the lower connection elements 51' are provided also form a loop 51" at their end which, like the loops 55, can serve to connect further elements. However, this alternative design of the load carrier is not absolutely necessary for the arrangement in different vertical positions; rather, the load carriers 50 and 90 of FIGS. 6*a* and 6*c* could also be attached to the carrying rack in different vertical positions.

For this purpose, the carrying rack has connection elements 41 and 41' arranged in different vertical positions in the region of its lower end, in particular in the form of horizontally aligned loops, as already described in more detail with regard to the load node 40.

The connection of the load carrier 50' in the lower position is shown on the right in FIG. 8*b* and corresponds to the connection already described above for FIG. 6*b*. In particular, here the connection elements 51' of the load carrier are connected to the lower row of connection elements 41 of the carrying rack. In the exemplary embodiment, this is done as already described via a rod 61, which is pushed through the loops forming the connection elements. Laterally and in the upper area, the connection is also made as already described for FIG. 6*a* via the connection elements 34 and 33 of the carrying rack.

The connection of the load carrier 50' in the upper position is shown on the left in FIG. 8*b*. In the area of the lower end, the connection elements 51' of the load carrier are now connected to the upper row of connection elements 41' of the carrying rack by pushing the rod 61 through the corresponding loops.

The higher position of the load carrier compared to the carrying rack requires further adjustments.

In particular, the stop elements 59 can be arranged at two different vertical positions on the load carrier, for which holes 59' arranged one above the other are provided in the exemplary embodiment.

Furthermore, two loops 34, 34' are provided in different vertical positions for lateral upper connection, so that the additional loop 34' is used in the higher position.

In the area of the upper edge, the strap members forming the loops 33 are extended upwards and have additional loops 33' at their end, which in the higher position are connected to the upper loops 53 of the load carrier by means of the rod 61. The fact that they additional loops 33' are not arranged directly on the carrying rack does not harm the stability in the connection, since this does not depend on the rigidity of the connection at the upper end due to the inherently rigid design of the load carrier 51' and the stop elements 59. Rather, the strength of the connection is determined by the lashing straps also engaging at the upper end.

Due to the higher position of the load carrier, the angle which the lashing straps 14, which are not shown here and which are also attached to the upper rod 61, have to the load carrier is more favorable.

7. Removable Waist Strap Padding

In the embodiment, the carrying rack comprises a waist strap 20 via which the load can be transferred to the wearer's waists, as is standard for hiking backpacks. In the case of hiking backpacks, the waist strap has padding.

In the military or rescue sector, however, the wearers of the carrying rack often carry a so-called tool belt, on which elements such as weapons, tools, ammunition, etc. are arranged, and which would therefore come into conflict with the padding of such a waist strap.

According to one aspect of the disclosure, the waist strap padding 22 can therefore be removed from the carrying rack and reattached.

Figure 10:
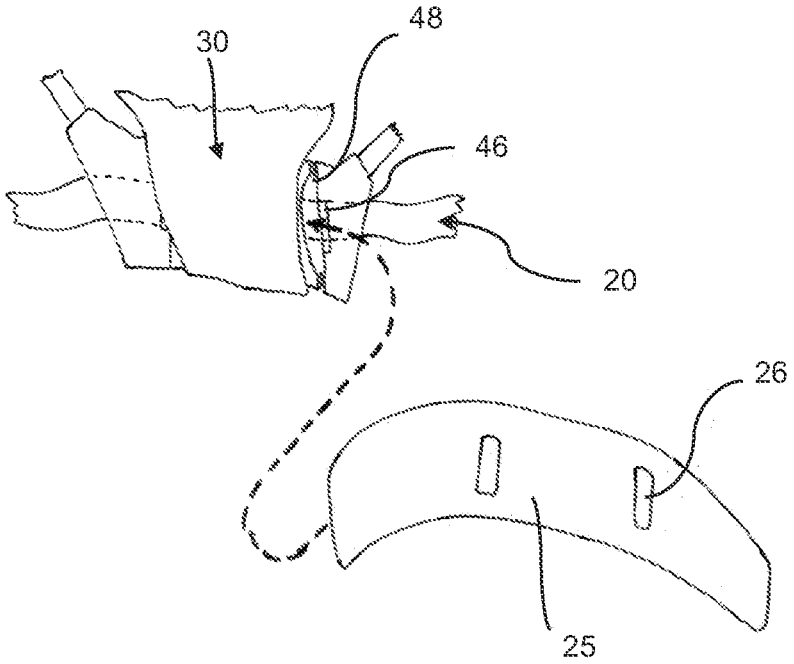
Figure 11:
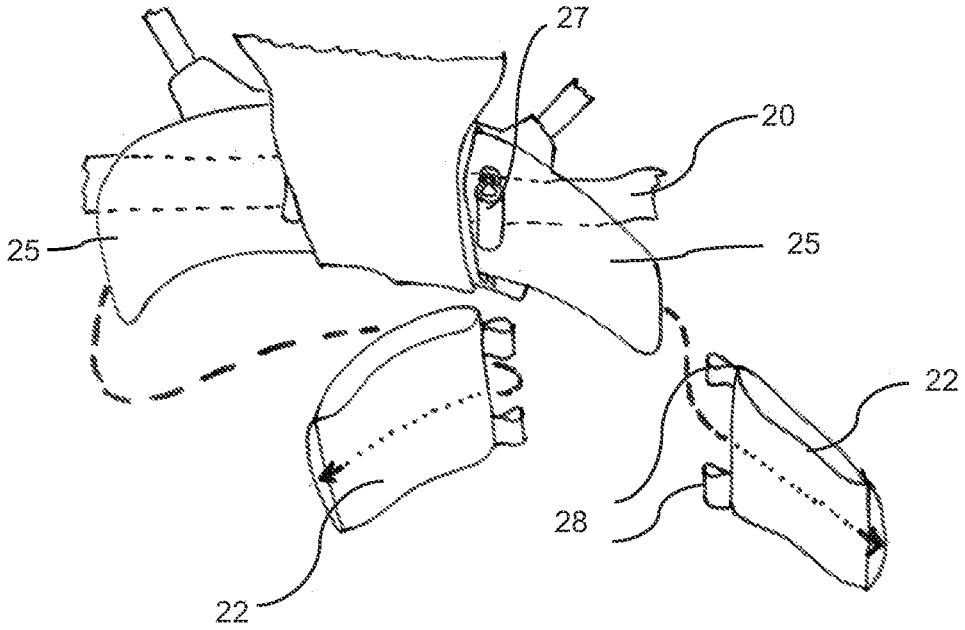
Figure 12:
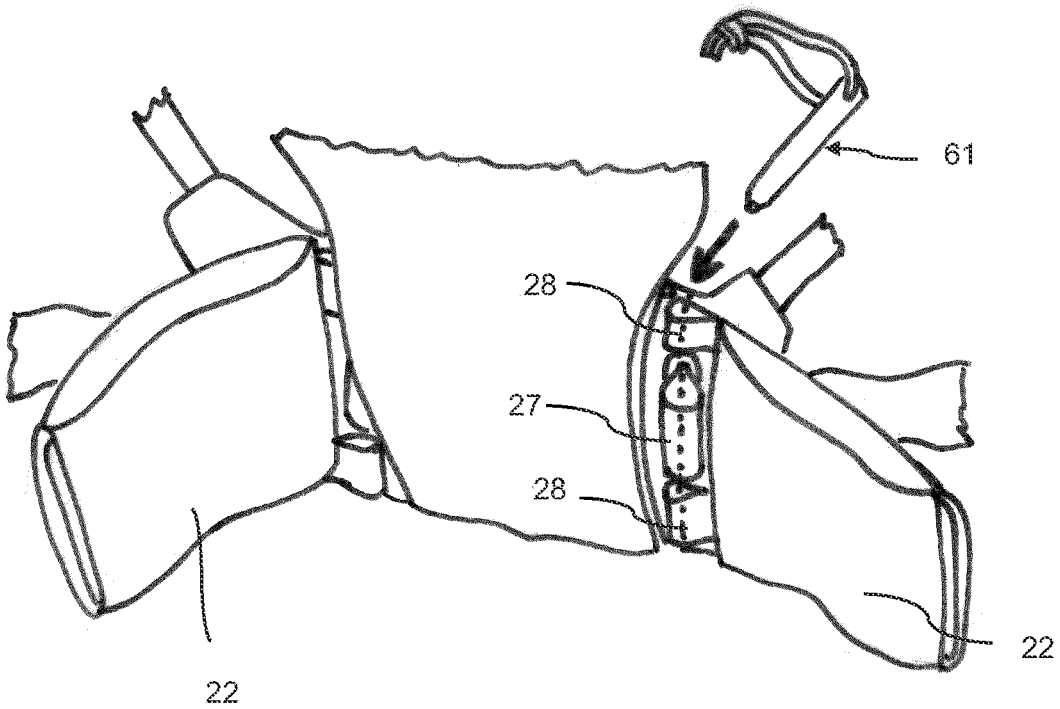

For this purpose, the waist strap padding elements 22 are connected to the carrying rack via a stiffening member 25, which is provided, for example, by a suitably cut plastic flap, as shown in FIGS. 10 to 12.

As shown in FIG. 10, the stiffening member 25 is guided in a horizontal direction through the pocket 47 between the shaped part 30, which forms the back plate, and the load node 40

As shown in FIG. 11, the waist strap padding elements 22 are pushed onto the two ends of the stiffening member 25, which have corresponding pockets for this purpose. The stiffening member 25 therefore forms a basic element for the waist strap padding on both sides of the back plate 30.

The connection between the stiffening member 25, the carrying rack and the waist strap padding elements 22 is made by providing a recess 46 in the connection area between the load node 40 and the two wings 45 arranged on the left and right of the load node 40 between hinge areas arranged at the top and bottom, through which the waist strap 20 can be pushed from behind in the form of a loop 27. The stiffening member 25 has corresponding slots through which the loop 27 is also pushed, with the front end being secured by means of corresponding rods 61 which are pushed through the loops 27 in a vertical direction and are secured by means of a rubber loop 62 which is attached to the upper end of the rod element 61 and is pulled over the lower end. Therefore, when the rods 61 are pulled out, the stiffening member 25 can be easily removed.

Waist strap padding elements 22 also comprise loops 28 at their inner end, which are aligned with loop 27 when slid open and are connected to it and thus to the carrying rack via rods 61.

The waist strap 20 extends to the rear of the waist strap padding elements 22, if present. If the waist strap padding elements 22 and the stiffening member 25 are removed, only the belt or strap as such remains, which does not come into conflict with a corresponding tool belt.

Loops, particularly for a PALS system, may be arranged on the back of the waist strap padding elements 22 for connecting additional elements.

8. Lumbar Pad

Since the back plate 30 follows the shape of the wearer's back, there is basically the problem that a wearer who is wearing a plate carrier or a protective vest under the carrying rack has a gap between the shaped part and the body in the area of the waist or lumbar spine, since the protective vest or plate carrier ends above this area.

Figure 13:
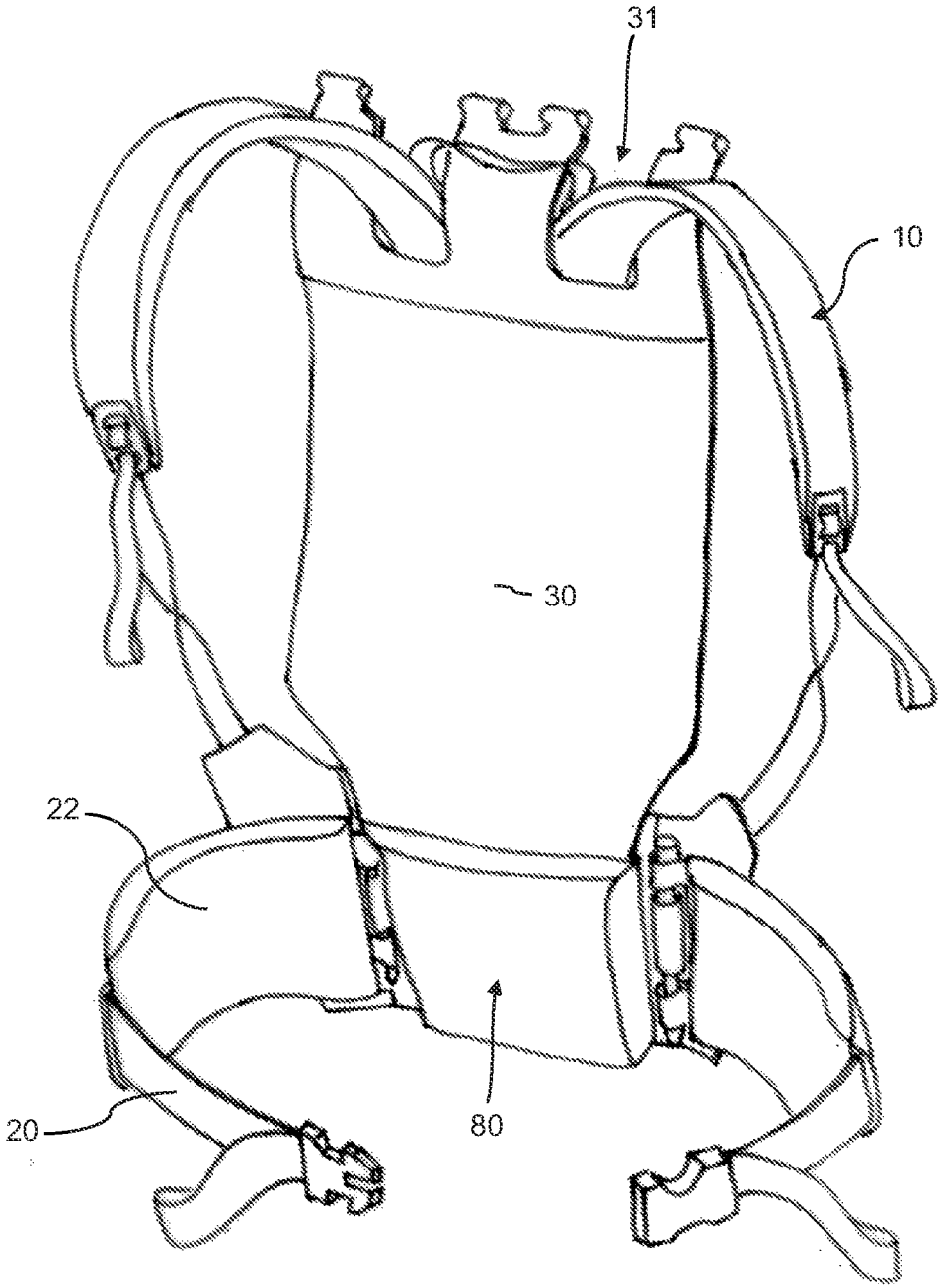

Therefore, as shown in FIG. 13, a lumbar pad 80 is provided, which preferably corresponds in thickness to the thickness of the plate support, and which can be attached to the front side of the back plate 30 in the lumbar region, in particular by embracing the back plate 30 on its rear side in the region between the back plate 30 and the load node 40.

In this case, the lumbar pad 80 has only the width of the shaped part 30, and is therefore arranged only in the back area.

The invention claimed is:

1. Carrying system for an item of equipment, comprising a carrying rack on which shoulder straps and a waist strap are arranged, a load carrier to which the item of equipment is releasably attachable, wherein the load carrier is releasably attachable to the carrying rack, wherein the carrying rack comprises a back plate, and wherein carrying rack further comprises a load node with a reinforcing plate, wherein both the waist strap and connection elements for connection to the load carrier are sewn to the reinforcing plate.

2. Carrying system according to claim 1, wherein the back plate and the load node overlap in a pelvic area, wherein the load node is arranged on a side of the back plate facing away from the load carrier, and/or wherein the load node and the back plate are connected to each other at their lower sides.

3. Carrying system according to claim 1, wherein the shoulder straps engage with the load node independently of the back plate, wherein each of the shoulder straps is connected to a strap member sewn to the reinforcing plate.

4. Carrying system according to claim 3, wherein the shoulder straps are connected to the load node in a height-adjustable manner, wherein strap members of the shoulder straps are guided starting from the load node upwards along the back plate to an upper side and/or front side of the shoulder straps, where they are fastened in a length-adjustable manner.

5. Carrying system according to claim 3, wherein buckles are connected to strap members sewn to the reinforcing plate, wherein strap members of the shoulder straps reach downwards to the buckles, are deflected at the buckles and are guided in the form of a loop back to the shoulder straps, where they are fastened in a length-adjustable manner to provide a height-adjustment of the shoulder straps, wherein the strap members comprise the strap member.

6. Carrying system according to claim 1, wherein the back plate is three-dimensionally adapted to a shape of a back and/or extends from a pelvic region to a shoulder region.

7. Carrying system according to claim 6, wherein the back plate is the only stiffening member of the carrying rack for vertical stiffening between pelvic region and shoulder region and/or wherein the back plate comprises at least two beads which extend in a vertical direction and are shaped in the direction of the load carrier which serve as a stop for the load carrier, wherein the at least two beads each comprise at least one recess on their rear side facing the load carrier, in which recess a stop element arranged on the load carrier engages, or wherein a rear side of the at least two beads facing the load carrier forms a flat surface against which the load carrier bears, and/or wherein the back plate comprises two incisions at its upper edge through which the shoulder straps of the carrying rack pass in a height-adjustable manner, and/or wherein the back plate comprises a bead extending along a spine and shaped in the direction of the load carrier, and/or wherein the back plate has a corrugated structure with corrugation crests and corrugation valleys extending in a horizontal direction.

8. Carrying rack of a carrying system according to claim 1.

9. Carrying system for an item of equipment, comprising a carrying rack on which shoulder straps and a waist strap are arranged, and a load carrier to which the item of equipment can be releasably attached, wherein the load carrier is formed by an inherently rigid carrying element which takes up the weight of the item of equipment in a vertical direction, wherein the carrying element is a carrying plate, wherein the load carrier is detachably attachable to the carrying rack, wherein the load carrier comprises first connection elements for detachable connection to second connection elements arranged at a lower end of the carrying rack, so that the introduction of force from the load carrier into the carrying rack takes place at the lower end thereof, and wherein the first connection elements are first textile loops arranged next to each other in a horizontal direction at the load carrier and the second connection elements are second textile loops arranged next to each other in the horizontal direction at the carrying rack, with a rod extending through the first textile loops and the second textile loops for connecting the load carrier and the carrying rack.

10. Carrying system according to claim 9, wherein the first connection elements are arranged on the load carrier in a region of its lower end and/or wherein the load carrier additionally has, in a region of its upper end and/or its sides, third connection elements by means of which it can be releasably connected to fourth connection elements of the carrying rack.

11. Carrying system according to claim 9, wherein a securing element is provided that secures the rod against sliding out of the first textile loops and the second textile loops, wherein the securing element is provided in addition to the first textile loops and the second textile loops.

12. Carrying system according to claim 9, wherein the first and second connection elements for connection between the load carrier and the carrying rack are arranged on a back side of the load carrier and a front side of the carrying rack facing each other and/or are formed by straps which are sewn to a flat material layer of the load carrier or carrying rack at two spaced-apart points.

13. Carrying system according to claim 9, wherein the load carrier comprises, in a region of an upper edge and/or side edges, fifth connection elements which enable a backpack element to be connected.

14. Carrying system according to claim 13, wherein first connection elements are loops for connection to the carrying rack and fifth connection elements are loops for connection of the backpack element, which are arranged in pairs one above the other and/or next to one another and produced in pairs by a webbing sewn several times to the load carrier.

15. Carrying system according to claim 9, wherein the carrying rack further comprises a load node to which the waist strap and the first connection elements for connection to the load carrier in a region of its lower end are attached.

16. Carrying system according to claim 9, wherein the carrying plate is sewn into a fabric pocket and/or consists of an aluminum-plastic layered material, and/or wherein the carrying plate comprises a plurality of recesses, at which at least one stop element is arranged on a side facing the carrying rack and/or at least one tensioning element and/or at least one positioning element is arranged on a side facing away from the carrying rack, wherein the at least one stop element, positioning elements and/or tensioning elements are screwed and/or screwable to the carrying plate.

17. Load carrier of a carrying system according to claim 9.

18. Carrying system for an item of equipment, comprising a carrying rack to which shoulder straps and/or a waist strap are arranged, and a load carrier to which the item of equipment is releasably attachable, wherein the load carrier is releasably attachable to the carrying rack, wherein a connection between load carrier and carrying rack is made via at least one rod which extends through textile loops arranged on the load carrier and/or on the carrying rack, and wherein a flexible band is arranged at one end of the rod, which band is pulled over the opposite end of the at least one rod protruding from the textile loops to secure the connection.

19. Carrying system according to claim 18, wherein the at least one rod is configured to be pushed through the textile loops on the carrying rack and the load carrier for establishing the connection, wherein the textile loops are arranged alternately on the load carrier and on the carrying rack and/or wherein the rod passes through the textile loops without play and/or wherein a securing element is configured to secure the rod against sliding out of the textile loops.

20. Carrying system for an item of equipment, comprising a carrying rack on which shoulder straps and a waist strap are arranged, and a load carrier to which the item of equipment can be releasably attached, wherein the load carrier is formed by an inherently rigid carrying element which takes up the weight of the item of equipment in a vertical direction, wherein the inherently rigid carrying element is a carrying plate, wherein the load carrier is detachably attachable to the carrying rack, wherein the load carrier comprises first connection elements for detachable connection to second connection elements arranged at a lower end of the carrying rack, so that the introduction of force from the load carrier into the carrying rack takes place at the lower end thereof, wherein the carrying rack further comprises a load node to which the waist strap and the first connection elements for connection to the load carrier in a region of its lower end are attached, and wherein the carrying rack further comprises a back plate overlapping with the load node in a pelvic region, with fourth connection elements to the load carrier being arranged on the back plate of the carrying rack.

* * * * *